US006932246B2

(12) United States Patent
Crosnier et al.

(10) Patent No.: US 6,932,246 B2
(45) Date of Patent: Aug. 23, 2005

(54) ASSEMBLY FOR PACKAGING AND DISPENSING A PRODUCT, ESPECIALLY IN THE FORM OF A SAMPLE

(75) Inventors: Daniel Crosnier, Offranville (FR); Florent Duqueroie, Paris (FR); Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 203 days.

(21) Appl. No.: 10/388,621

(22) Filed: Mar. 17, 2003

(65) Prior Publication Data

US 2003/0209567 A1 Nov. 13, 2003

(30) Foreign Application Priority Data

Mar. 15, 2002 (FR) ..... 02 03262
Mar. 15, 2002 (FR) ..... 02 03261

(51) Int. Cl.[7] ..... B65D 88/54

(52) U.S. Cl. ..... 222/321.2; 222/321.7; 222/321.9; 222/336; 222/482; 239/472; 239/492

(58) Field of Search ..... 222/321.1, 321.2, 222/321.7, 321.9, 336, 381, 482; 239/463, 468, 472, 474, 490, 491, 492

(56) References Cited

U.S. PATENT DOCUMENTS

| | | | | |
|---|---|---|---|---|
| 3,412,907 A | | 11/1968 | Faso | |
| 3,627,206 A | * | 12/1971 | Boris | 239/333 |
| 3,774,849 A | * | 11/1973 | Boris | 239/338 |
| 3,897,005 A | | 7/1975 | Reiner | |
| 3,940,030 A | | 2/1976 | Kondo | |
| 4,175,704 A | * | 11/1979 | Cohen | 239/320 |
| 4,228,931 A | * | 10/1980 | Ruscitti et al. | 222/321.2 |
| 5,102,018 A | * | 4/1992 | Desazars de Montgailhard et al. | 222/321.9 |
| 5,242,089 A | * | 9/1993 | Knickerbocker et al. | 222/321.7 |
| 5,257,726 A | * | 11/1993 | Graf et al. | 222/320 |
| 5,271,532 A | * | 12/1993 | Jumel et al. | 222/321.9 |
| 5,277,340 A | * | 1/1994 | Van Brocklin | 222/321.7 |
| 5,427,280 A | * | 6/1995 | Fuchs | 222/320 |
| 5,617,976 A | | 4/1997 | Gueret | |
| 5,651,480 A | * | 7/1997 | Piepenstock | 222/341 |
| 5,709,320 A | | 1/1998 | Jimenez | |
| 6,273,301 B1 | * | 8/2001 | Su | 222/321.9 |

FOREIGN PATENT DOCUMENTS

| | | |
|---|---|---|
| DE | 1 971 372 | 1/1999 |
| EP | 0 761 314 | 3/1997 |
| FR | 2 443 980 | 7/1980 |
| FR | 2 646 408 | 11/1990 |
| FR | 2 650 763 | 2/1991 |
| FR | 2 778 639 | 11/1999 |

OTHER PUBLICATIONS

U.S. Appl. No. 10/846,519, filed May 17, 2004, Albisetti et al.

* cited by examiner

*Primary Examiner*—Michael Mar
*Assistant Examiner*—Patrick Buechner
(74) *Attorney, Agent, or Firm*—Oblon, Spivak, McClelland, Maier & Neustadt, P.C.

(57) ABSTRACT

An assembly for packaging and dispensing a product, especially a cosmetic product. The assembly includes a container containing the product and delimited by a body, one end of which is closed by a bottom. A movable component is movable relative to the body of the container and is capable, in response to an action exerted manually on a surface of an actuation component, of passing from a first position in which the volume delimited between the movable component and the bottom of the container is a maximum, to a second position in which the volume is a minimum, so as to pressurize the product contained in the volume and deliver the product through at least one dispensing orifice. When the movable component returns from the second position towards the first, air passes into the volume through at least one passage formed between the movable component and an internal surface of the container.

53 Claims, 15 Drawing Sheets

Fig. 1
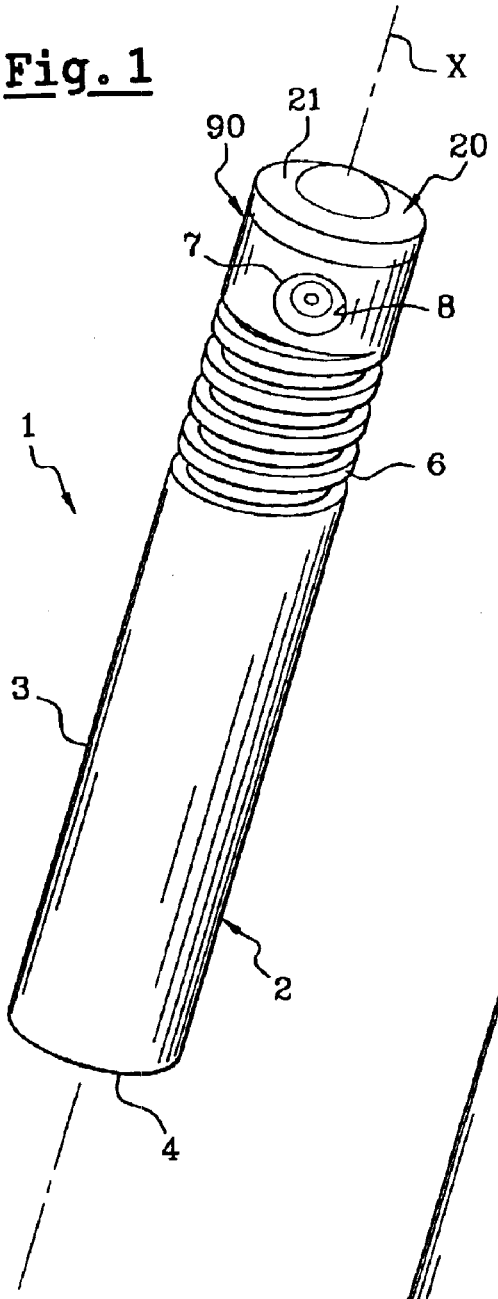
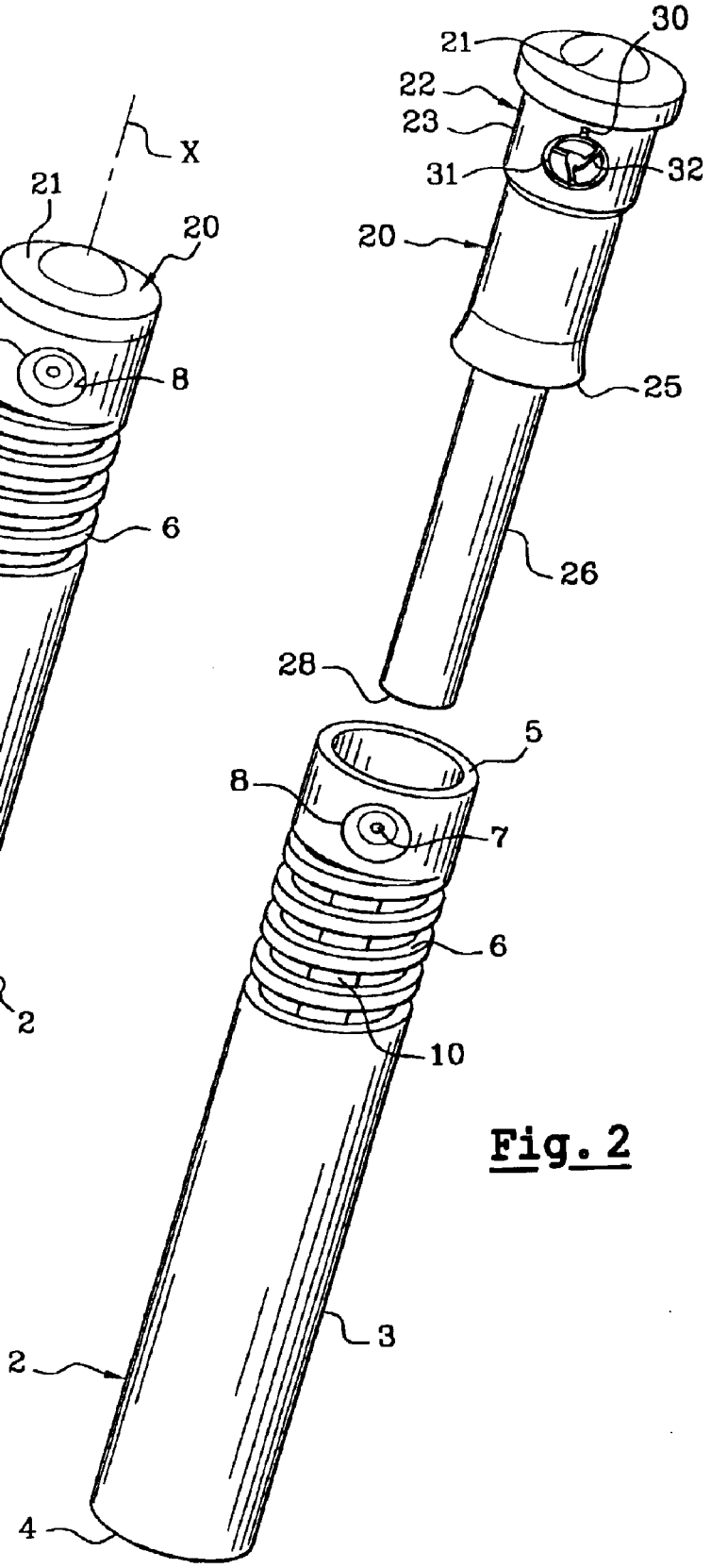
Fig. 2

ASSEMBLY FOR PACKAGING AND DISPENSING A PRODUCT, ESPECIALLY IN THE FORM OF A SAMPLE

CROSS REFERENCE TO RELATED APPLICATIONS

This document claims priority to French application numbers 0203261 and 0203262, filed Mar. 15, 2002, the entire content of which is hereby incorporated by reference.

FIELD OF THE INVENTION

The present invention relates to a device for packaging and dispensing a fluid product under pressure, preferably in a spray form. The invention is particularly preferable in the form of a miniature spray, preferably a disposable one which is designed for packaging cosmetic products, especially perfumes, in the form of a sample. The product is preferably liquid.

BACKGROUND OF THE INVENTION

Discussion of Background

Examples of dispensers are described in Patent Applications FR-A-2 778 639, EP-A-0 761 314, FR-A-2 443 980 or in U.S. Pat. No. 3,897,005 or U.S. Pat. No. 3,412,907. These devices suffer principally from at least one handicap associated with their manufacturing cost, ease of use, or with the quality of the spray they are capable of generating. Since the samples are generally not intended for sale, their manufacturing cost should be as low as possible. It is therefore important to have devices whose pieces can be easily mass-produced and which can be fitted together in a simple way. They should furthermore be capable of generating a high quality spray, with characteristics that are as constant as possible.

Furthermore, in particular for perfumes, it is known to provide samples in a small volume container (typically 1.5 ml) having a cylindrical body, especially one made of glass, one end of which is closed by a bottom. The other end is open and accommodates a miniature pump, on top of which there is an actuation component having an orifice for spraying the perfume. Such a system is described in FR-A-2 646 408.

The miniature pump, like pumps fitted to containers with larger dimensions, includes a pump body inside of which a plunger can move between a first position, in which the pump body has a maximum volume, and a second position in which the volume of the pump body is a minimum. The pump body selectively communicates with the container via a riser tube and an intake valve, such as a ball valve. During the phase in which the volume of the pump body is reduced, the intake valve is closed. A delivery valve located upstream of the dispensing orifice, however, is opened under the pressure of the product. The product is dispensed in a sprayed form.

When the user relaxes the pressure being exerted on the actuation component, the plunger is raised by a spring to the first position, hence creating a reduced pressure inside the pump body. In this phase, which is referred to as the filling phase, the intake valve is opened by the reduced pressure prevailing inside the pump body, and the delivery valve is closed. Furthermore, a volume of air corresponding to the volume of product transferred from the container towards the pump body enters the container during this phase via a suitable vent orifice.

Although satisfactory in terms of simplicity of use for the consumer and the quality of the spray which is obtained, this system of a miniature container equipped with a miniature pump suffers from a major drawback associated with its cost and the complexity of handling and assembling small-dimensioned components.

Containers having a movable plunger and dispensing orifice, to pressurize and deliver the product, are also known from U.S. Pat. No. 5,709,320. However, these devices employ plungers which are complex and expensive due, for example, to the use of non-return valves.

SUMMARY OF THE INVENTION

It is therefore an object of the invention to provide a packaging and dispensing assembly.

It is a further object of the invention to provide such an assembly which is particularly suitable for packaging and dispensing sample doses of a product, such as a cosmetic product, under pressure, and which solves all or some of the drawbacks discussed above with reference to conventional devices.

It is another object of the invention to provide such an assembly which is economical to manufacture and simple to use.

The above, as well as other objects and advantages will become apparent in the detailed description herein.

The assembly for packaging and dispensing a product according to the invention include a container delimited by a body having a closed bottom at one end and a component which is movable relative to the body of the container. The movable component is capable, in response to force exerted manually on a surface of an actuation component, passing from a first position in which the volume delimited between the movable component and the bottom of the container is a maximum, to a second position in which the volume is a minimum, so as to pressurize the product contained in the volume and cause its delivery through at least one dispensing orifice. When the actuating action or force ceases, the movable component returns from the second position towards the first. This return movement is accompanied by the intake of air inside the volume, with the intake of air taking place through at least one passage formed between the movable component and an internal surface of the container.

In contrast to the conventional pump devices in which only the product contained inside the pump body is pressurized, in accordance with the arrangement of the invention all of the product contained in the container is pressurized upon each actuation. Since the bottom of the container is closed, the volume of product dispensed during a given actuation is not replaced. Once the dispensing is initiated, therefore, the volume of product pressurized in the container decreases upon each subsequent actuation.

In a conventional pump body, optionally after an initiation phase, and for as long as the volume of product contained in the container is larger than the volume of the pump body, a volume of product similar to the volume of product which has been dispensed enters the pump body during each suction phase. Therefore substantially the same quantity of product is pressurized inside the pump body upon each actuation. The dispensed volume of product may be compensated for by a volume decrease of the container. One way of doing this is to provide for the bottom to have a non-fixed axial position, and for it to rise after each actuation, a non-return mechanism of the rack type preventing it from moving back when the movable component passes from the first position to the second.

Advantageously in accordance with the arrangement of the invention, however, the dispensed volume of product is replaced by a corresponding volume of air, which enters the volume when the actuation component is returning from the second position toward the first.

In the conventional pumped devices, the intake of air takes place in the part of the container external to the pumping chamber. In the conventional systems, the number of pieces may be as much as 10.

However, in accordance with the arrangement of the invention, an assembly can be provided with a minimal number of pieces, which number, as will be seen in more detail below, may be as little as two. With the assembly according to the invention, therefore, the assembly operations are minimized or reduced. The cost price or manufacturing cost can therefore be extremely low.

The value or size of the minimal volume remaining between the plunger and the fixed bottom, when the plunger is in its lowermost position, determines the number of sprays which it is possible to generate with the assembly according to the invention.

Preferably, the movable component includes a lip which can be applied in a leaktight fashion against an internal surface of the container when the movable component is passing from the first position to the second. The internal surface is configured so that, over at least a part of the return movement of the movable component from the second position to the first, the lip is not in leaktight contact with the internal surface of the container. It is precisely during this period when the lip is not in leaktight contact with the internal surface of the container that the intake of air inside the variable volume takes place.

Advantageously, over at least a part of the movement between the first and second positions, the lip is preferably subjected to an elastic force which increases in the direction toward the second position.

With the arrangement of the invention, when the user relaxes the pressure being exerted on the actuation surface, the plunger rises axially in the direction opposite to that of the closed end or bottom of the container, under the effect of a spring. Simultaneous with this rising movement, the lip of the plunger tends to move radially away from the axis as the radial elastic stress to which it is subjected decreases, so as to remain in engagement with the internal surface of the container. Due to the inertia of the material forming the lip of the plunger and the slightly reduced pressure which is created when the rising movement is initiated, however, this radial movement is less rapid than the abrupt rising movement. The air therefore has sufficient time to enter inside the variable volume before the lip reestablishes a seal against the internal surface of the container.

More specifically, the internal surface of the container can have a circular cross section, with the lip being annular, and with the distance between a longitudinal axis of the assembly and the said internal surface increasing, preferably progressively, in the direction of the return movement from the second position towards the first. The radial movement discussed above is thereby permitted by the progressive increase of the distance separating the free edge of the lip from the internal surface of the container.

In order to obtain the desired effect, various parameters can be utilized and adjusted relative to one another. These parameters can include, for example, the material forming the movable component, and in particular the lip. The material is preferably chosen so that the radial movement of the free edge of the lip, due to its elasticity, is slower than the rising movement of the movable component. A material such as polyethylene has been found to be satisfactory. The parameters can also include the configuration of the lip, in particular its thickness or its inclination at rest. The configuration has an impact on the twofold relative movement to which the lip is subjected when the movable component is passing from the second position to the first. In addition, the parameters can include the profile of the internal surface of the container, and in particular the variation in distance from the lip to the internal surface of the container between the first and second positions of the movable component. Further, the parameters can include the elasticity or force provided by the device restoring the movable component into the second position. The elasticity or force should be sufficient to cause a rapid rise of the movable component when the actuation pressure on the actuation surface ceases.

The movable component can be formed, for example, by molding the movable component with the actuation component.

The elastic restoring device can be formed, for example, by molding the device with the actuation component, with the body of the container, or with both of them. The elastic restoring device can be, for example, a spring. In accordance with one form of the invention, the spring is separate from the body of the container, which makes it possible to produce the assembly by using a first material for the spring, having the requisite elastic properties, and a second material for the body, which is compatible with the decoration, writing or printing which may be desirable to display on the body of the container. For instance, a polyoxymethylene (POM) may be used for the spring and a polypropylene may be used for the body of the container.

As a further alternative, the elastic restoring device can be molded with an intermediate piece, onto which the actuation component is fitted. In this latter situation, it is possible to provide a spring on the end of the intermediate piece located in the vicinity of the bottom of the container. In this case, one end of the spring can abut against the bottom of the container.

Preferably, the elastic restoring device, as well as any element molded therewith is made of POM. Where the movable component and/or the body of the container are not molded with the elastic restoring device, they may be made of at least one polyolefin, preferably a polyethylene or a polypropylene.

According to another variant, the elastic restoring device can include an attached spring, such as one made of plastic or metal.

The dispensing orifice is in selective communication, via an opening/closure system, with at least one feed passage in communication with the product inside the container. In practice, the communication between the dispensing orifice and the feed passage is established at least when the movable component is in the second position.

The feed passage can be delimited between an element secured to the body of the container, for example, an element molded with the container, and an element secured to the movable component, such as an element molded with the movable component. Alternatively, the feed passage can be delimited essentially by the movable component. Also alternatively, the feed passage can be delimited between an element secured to the body of the container (e.g., an element molded with the container) and the intermediate piece.

The opening/closure system may be formed by the interaction of an element coupled or secured to the body of the container, e.g., one molded with the body, and an element coupled or secured to the movable component, e.g., an element molded with the movable component. Alternatively, the opening/closure system may be formed by the interaction of the movable component and a portion secured to the actuation component. Also alternatively, the opening/closure system can be formed by the interaction of a portion of an intermediate piece and a portion secured to the actuation component.

Advantageously, the surface of the actuation component is movable over a travel amount or distance which is greater than the travel of the rest of the actuation component, with the communication between the feed passage and the dispensing orifice established in response to the movement of the surface of the actuation component when the rest of it is axially stationary. To that end, the actuation surface may be convex and annularly bordered by a portion with a smaller thickness, so as to permit inversion of the profile of the actuation surface when the rest of the actuation component is axially immobilized.

The second position of the movable component can be determined or formed by the engagement of a lower end of the movable component with the bottom of the container, or with any other stop encountered by the movable component or by any other element to which the movable component is coupled.

Where the second position is determined by the abutment of an annular edge of the movable component with the bottom of the container, it may be advantageous to provide for the annular edge to be crenellated, or for the bottom of the container to have reliefs capable of maintaining communication between the feed passage and the rest of the container.

The bottom of the container can be an attached bottom, with the bottom fastened onto the body of the container, e.g., by snap-fastening, screwing, adhesive bonding or welding. In this case, the stopper can be molded with the body of the container, with the stopper molded in the open position and connected to the body by a strip of material.

In a preferred feature, the dispensing orifice can be advantageously fed by a plurality of vortex-effect channels. The channels can be hollowed portions either in the part of the body through which the dispensing orifice passes or in any other part arranged facing the dispensing orifice (movable component, intermediate piece).

The elastic restoring device can be, e.g., configured in the form of a stack of at least three rings which are connected two by two via two diametrically opposite struts, with the struts separating a first ring from a second ring adjacent to the first being offset at 90° with respect to the struts separating the second ring from a third ring, which is adjacent to the second. This arrangement greatly facilitates the molding of the piece forming the spring.

BRIEF DESCRIPTION OF THE DRAWINGS

A better appreciation of the invention and many of the attendant advantages thereof will become further apparent from the following detailed description, particularly when read in conjunction with the accompanying drawings in which:

FIGS. 1, 2, 3A–3C depict a first embodiment of the packaging and dispensing assembly according to the invention;

DETAILED DESCRIPTION OF THE PREFERRED EMBODIMENTS

Figure 3A:
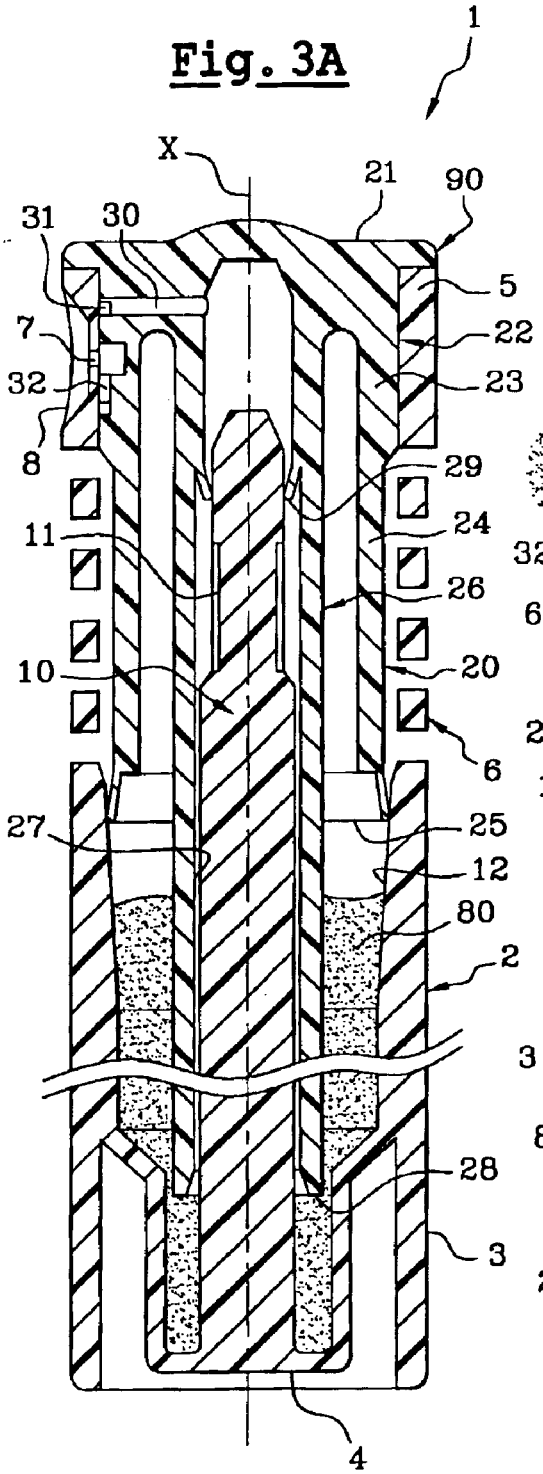

As represented in the assembled overall perspective view of FIG. 1, the device 1 according to a first embodiment of the invention includes an elongate container 2 having, for example, a cylindrical shape. The container includes a body 3, one end of which is closed by a bottom 4. The other end 5 is open. In the vicinity of its open end 5, the body 3 of the container has a portion forming a spring 6, which in this example is formed by molding with the body 3 of the container. Above the spring 6, the wall of the body 3 is pierced by a dispensing orifice 7 which opens at the bottom of a recess 8.

As is shown more clearly by FIGS. 2 and 3A–3C, an element 10 extends axially from the bottom 4 of the container to a level slightly above the uppermost portion of the spring 6. The axial element 10 has a first diameter extending along, for example, about three-quarters of its height, starting from the bottom 4, and a second diameter, which is smaller than the first, extending the upper quarter of its height. The small-diameter lower part 11 of the portion includes a plurality of ribs which, as will be seen in more detail below, are intended to allow selective communication to be established between the dispensing orifice 7 and a feed channel 27, which will also be discussed in more detail below.

Over substantially the entire upper half of the part of the body 3 located below the spring 6, the cross section on the internal surface 12 of the container increases progressively, owing to a progressive reduction in the thickness of the wall of the body 3 over the half in question. In the illustrated example, the difference in thickness between the thickest part of the wall and the thinnest part, adjacent to the spring 6, is on the order of from 1 to 2 mm.

An element 20 provides a movable element or movable component and has a height slightly less than the height of the body 3 of the container 2. This element 20 is introduced inside the body 3 via its open end 5. The element 20 has a transverse wall 21 whose external diameter is substantially equal to the exterior diameter of the free end 5 of the body 3, so as to bear on the free edge. In combination with the surface 21 of the movable component 20, the end portion 5 of the body 3, in which the dispensing orifice 7 is also formed, provides an actuation component which is generally denoted by the reference 90.

A lateral skirt 22 connects with the vicinity of the periphery of the transverse wall 21. Over a part 23 of its height corresponding substantially to the height of the part of the body 3 located above the spring 6, the lateral skirt 22 has an external diameter slightly smaller than the internal diameter of the body 3, so as to be inserted tightly inside the body 3.

The part 23 is extended by a smaller-diameter portion 24 terminating in an annular lip 25, which is turned downwards and flares outward slightly so as to be in leaktight engagement with the internal surface 12 of the body 3. In the resting position illustrated in FIG. 3A, the annular lip 25 is just below the lower end of the spring 6 and delimits a volume 80, which is a maximum in this position, above the bottom 4.

An axial skirt 26 also connects with the transverse wall 21. The axial skirt 26 has an internal diameter slightly larger than the external diameter of the larger-diameter portion of the axial element 10, so as to be engaged around the latter while leaving an annular passage 27. In the resting position illustrated in FIG. 3A, a crenellated edge 28 of the axial skirt 26 is located at a distance from the bottom 4 at least equal to the desired actuation travel, while preferably being as close as possible to the bottom in order to be immersed in the product for as long as possible.

In the vicinity of its upper end, the internal surface of the axial skirt 26 includes an annular lip 29 which is turned downwards and is inclined in the direction of the axis X of the assembly. In the resting position of the assembly illustrated in FIG. 3A, the lip 29 is in leaktight engagement against the part of the axial element 10 located above the ribbed portion 11.

On the side facing the dispensing orifice 7, a radial passage 30 passes through the wall of the axial skirt 26 and opens into a recess 31 formed on the external surface of the part 23 of the lateral skirt 22. When the assembly is fitted together, the recess 31 is centered on the dispensing orifice 7 and, with the internal surface of the body 3, defines a plurality of vortex channels 32 in communication with the spray orifice 7 and with the radial passage 30.

Although not represented in the drawing, snap-fastening may be provided between the movable component 20 and the body 3 of the container, so as to improve their interlocking with one another.

According to this embodiment, the container 2 and the spring, with which it is obtained by molding, are preferably made, for example, of POM. The movable component is made of polyethylene or polypropylene.

Figure 3B:
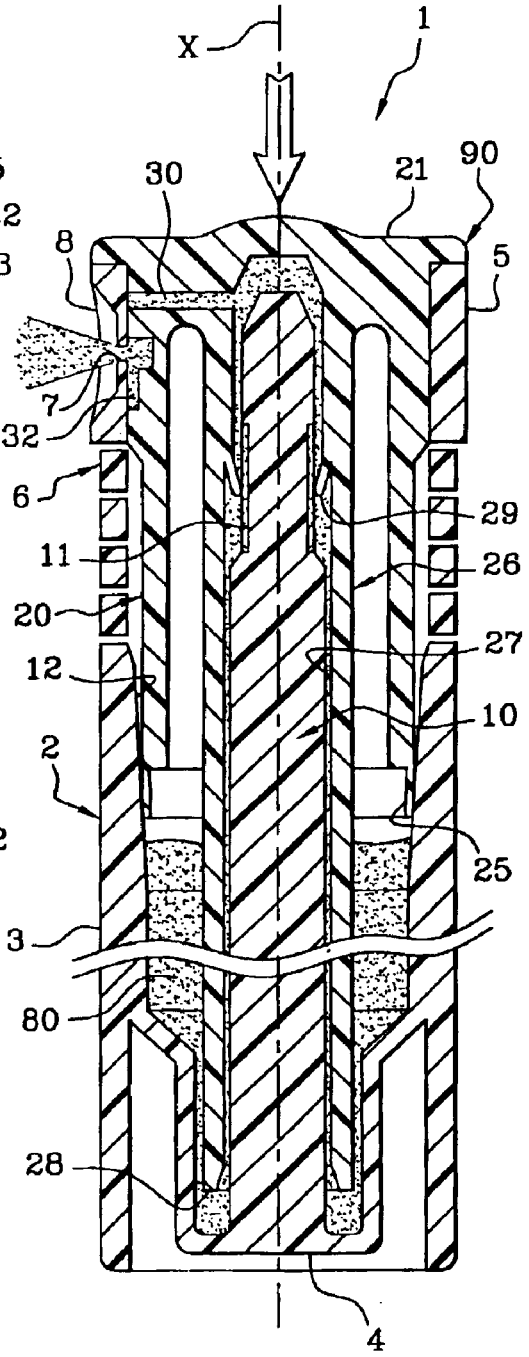
Figure 3C:
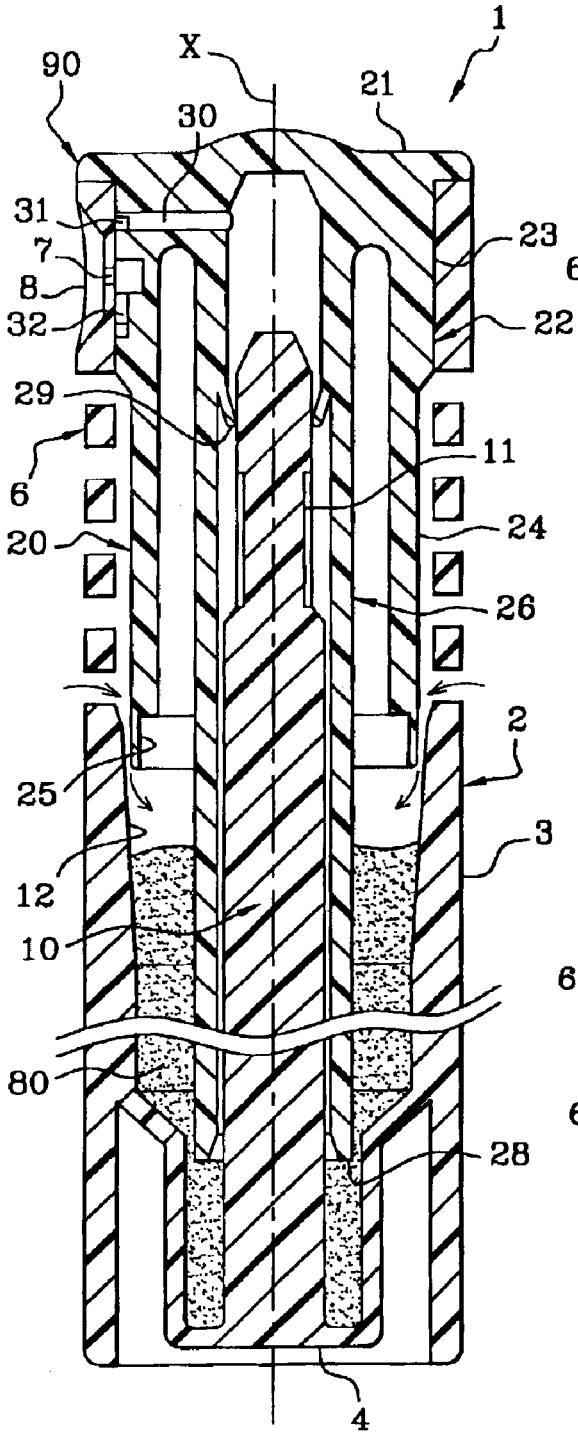

During use, the consumer exerts an axial pressure on the surface 21 of the actuation component 90 (FIG. 3B). In response to this axial pressure, the spring 6 compresses and the movable component 20 descends with the annular lip 25 in leaktight engagement with the internal surface 12 of the body 3. When this happens, the volume 80 defined between the bottom 4 and the movable component 20 decreases, and the product which is contained in it is pressurized and rises through the annular passage 27.

The insertion movement continues until complete compression of the spring 6 or until the crenellated edge 28 of the axial skirt 26 abuts against the bottom 4 of the container 2. In this position, the volume 80 is a minimum.

In this position, the annular lip 29 faces the ribbed portion 11 of the axial element 10. The product contained in the annular passage 27 passes between the ribs of the portion 11, flows through the radial passage 30 into the vortex channels 32, and is sprayed via the dispensing orifice 7.

When the consumer relaxes the pressure being exerted on the surface 21 (FIG. 3C), the movable component 20 rises axially under the effect of the spring 6. When this happens, the annular lip 29 ceases to be in front of the ribbed portion 11 and returns to leaktight engagement with the portion located above the ribbed zone 11.

The progressively decreasing thickness of the wall of the body 3 of the container 2, coupled with the inertia or pliability of the material forming the annular lip 25 of the movable component, with the abrupt thrust generated by the spring 6, and with the slightly reduced pressure which can be created inside the container when the rising movement of the movable component 20 is initiated, is favorable for maintaining a slight separation between the free edge of the annular lip 25 of the movable component 20 and the internal surface 12 of the body 3, and for doing so during at least a part of the rising movement of the movable component 20. Accordingly, air can then flow inside the container 2, so as to reestablish a pressure equilibrium.

When the movable component 20 reaches its upper position (FIG. 3A), the free edge of the annular lip 25 is again in leaktight engagement with the internal surface 12 of the body of the container. The volume 80 is again a maximum. The assembly is then ready for subsequent actuation. During the next actuation, everything takes place in the same way, except the volume pressurized by the movable component is reduced by the volume of product which was dispensed during the previous actuation, this volume having been replaced by a corresponding volume of air.

Figure 4A:
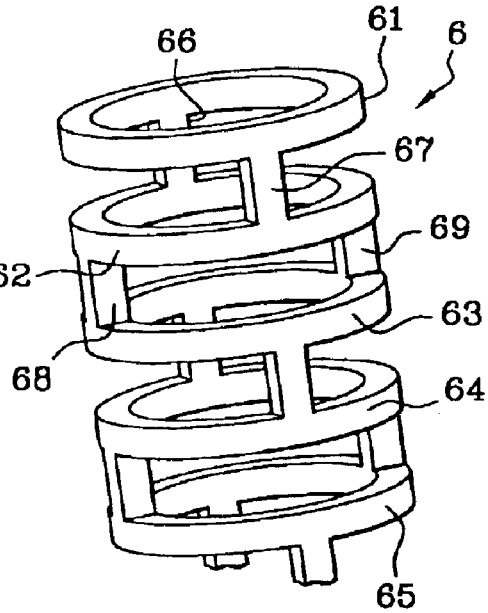
FIGS. 4A–4B illustrate a variant of the spring arrangement of the first embodiment.
Figure 4B:
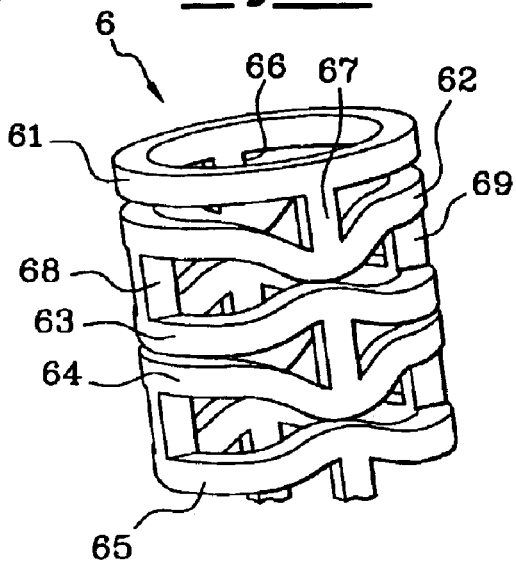
Figure 5:
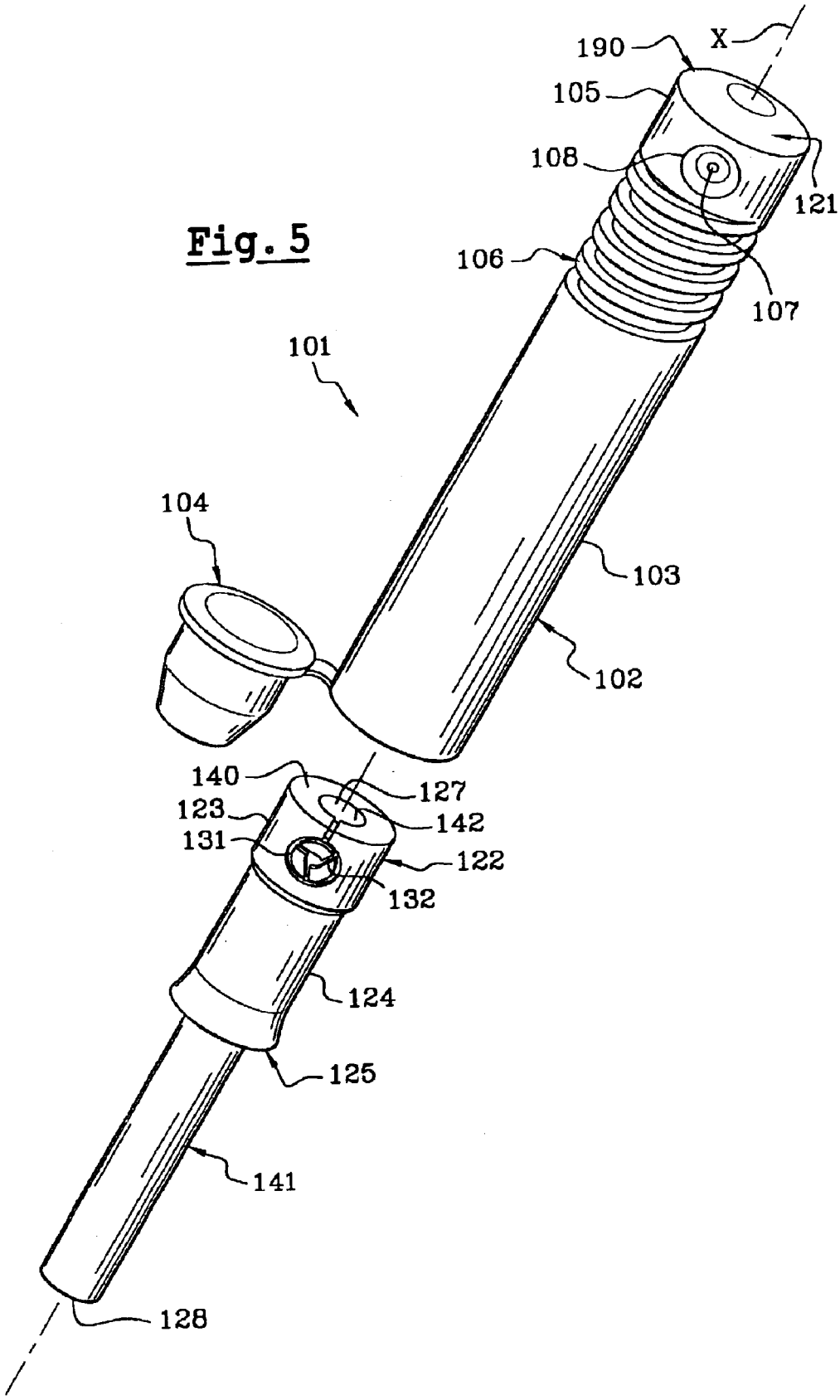
FIGS. 5 and 6A–6D depict a second embodiment of the packaging and dispensing assembly according to the invention.

In the embodiment which has just been described, the elastic restoring means 6 is configured in the form of a coil spring. In the variant of FIGS. 4A and 4B, the spring 6 is configured in the form of a stack of a plurality of rings 61, 62, 63, 64, 65. Two consecutive rings 61, 62 are kept at a distance from one another by two diametrically opposite struts 66, 67, whereas the rings 62 and 63 are kept at a distance from one another by two struts 58, 69, which are offset in the illustrated embodiment by 90° with respect to the struts 66, 67, and so on throughout the stack.

In compression, and as represented in FIG. 4B, the rings 61–65 of the stack move towards one another two by two, with a maximum proximity, or even contact, at the positions located at 90° with respect to the struts. Because of the 90° offset of the struts of one pair of rings from the struts of the pair(s) of rings which are adjacent to it, the stack compresses uniformly.

The spring according to the configuration of FIGS. 4A and 4B can also be used for other embodiments of the assembly, examples of which are described below.

In the embodiment of FIGS. 5 and 6A–6D, the assembly 101 includes a container 102 having a cylindrical body 103 made of POM, one end of which is open and one end of which can be sealed in a leaktight fashion by a bottom 104, which can also be molded with the container 102. The bottom 104 may be fastened onto the body 103 by force-fitting, snap-fastening, welding or adhesive bonding.

In the vicinity of its opposite end from the bottom 104, the body 103 of the container has a portion which forms a spring 106 and is obtained by molding with the body 103 of the container. Above the spring 106, the wall of the body 103 is pierced by a dispensing orifice 107 which opens at the bottom of a recess 108. The upper end 105 of the body 103 is closed by a convex transverse wall 121, which can be molded with the rest of the body. In the vicinity of its periphery, the surface 121 has an annular zone 146 having a smaller or reduced thickness, which, as will be seen in more detail below, makes it possible to press or invert the convex wall 121. The part of the body 103 which is located above the spring 106, and which is closed by the convex wall 121, constitutes the actuation component 190.

As can be seen in FIGS. 6A–6D, and in the same way as for the previous embodiment, the wall of the body has a thickness increasing progressively in the direction of the bottom 104 below the spring 106, and substantially over one-third of the height of the body 103 located under the spring in the illustrated embodiment. Over this portion of the body 103, the distance to the axis X from the internal surface 112 of the body 103 hence increases progressively in the opposite direction from the bottom 104.

The assembly according to this embodiment also includes a movable component 120 made of polyethylene, having a lateral skirt 122 whose external diameter, at least in its upper part 123, is slightly less than the internal diameter of the body 103, so that the movable component can be fitted tightly into the body, or attached by any other expedients, for example by snap-fastening.

The part 123 is extended by a smaller-diameter portion 124 terminating in an annular lip 125, which is turned downwards while flaring outwards slightly so as to be in leaktight engagement with the internal surface 112 of the body 103. In the resting position illustrated in FIG. 6A, the annular lip 125 is just below the lower end of the spring 6. The volume 180 which it delimits above the bottom 104 is a maximum.

The lateral skirt 122 connects in the upper part with an annular collar 140, which itself connects with an axial skirt 141 delimiting an axial passage 127. In the resting position shown in FIG. 6A, the annular collar 140 is at a distance from the internal surface of the convex end wall 121.

Figure 6A:
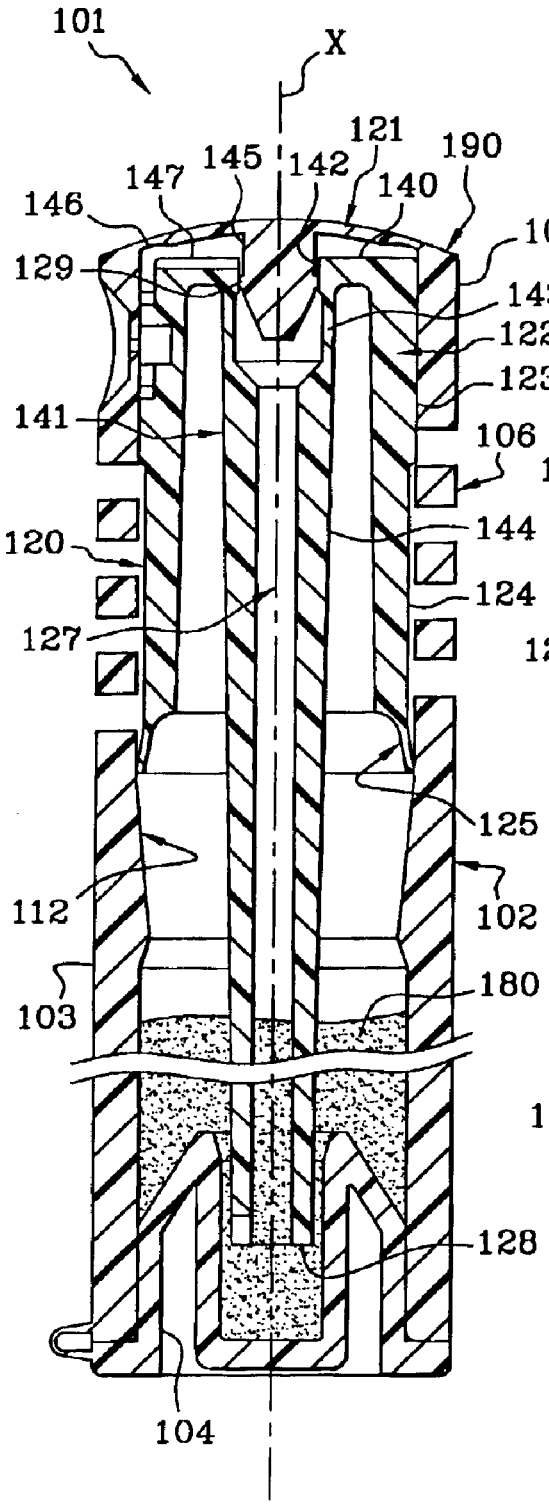
Figure 6B:
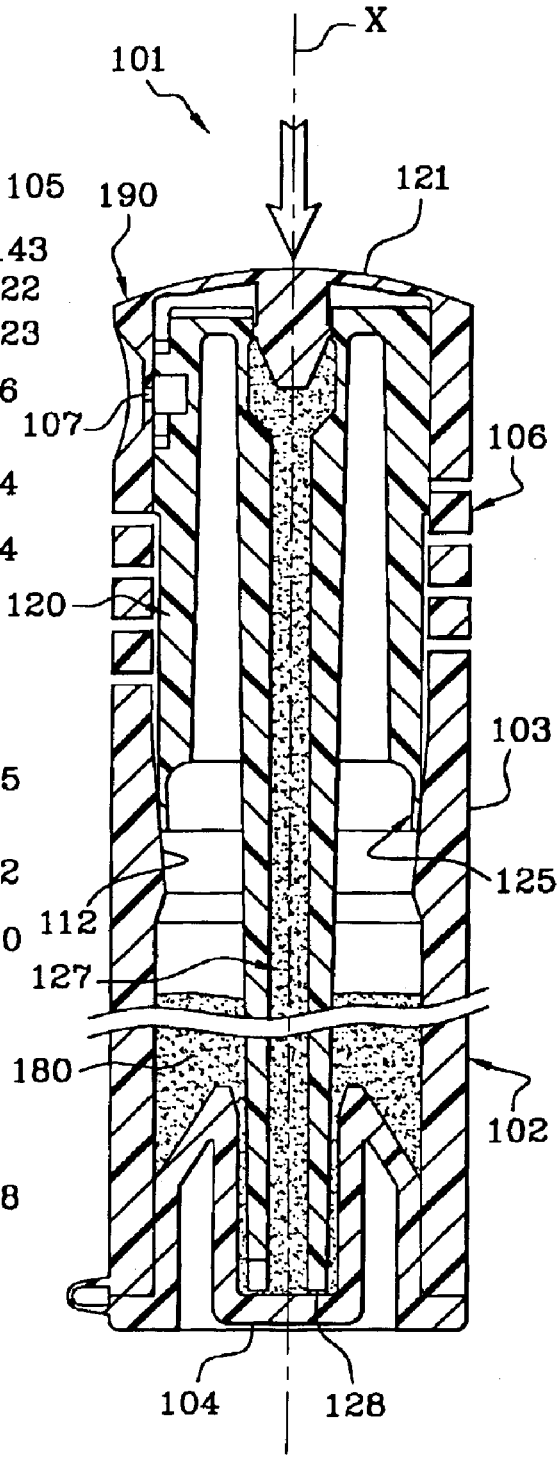
Figure 6C:
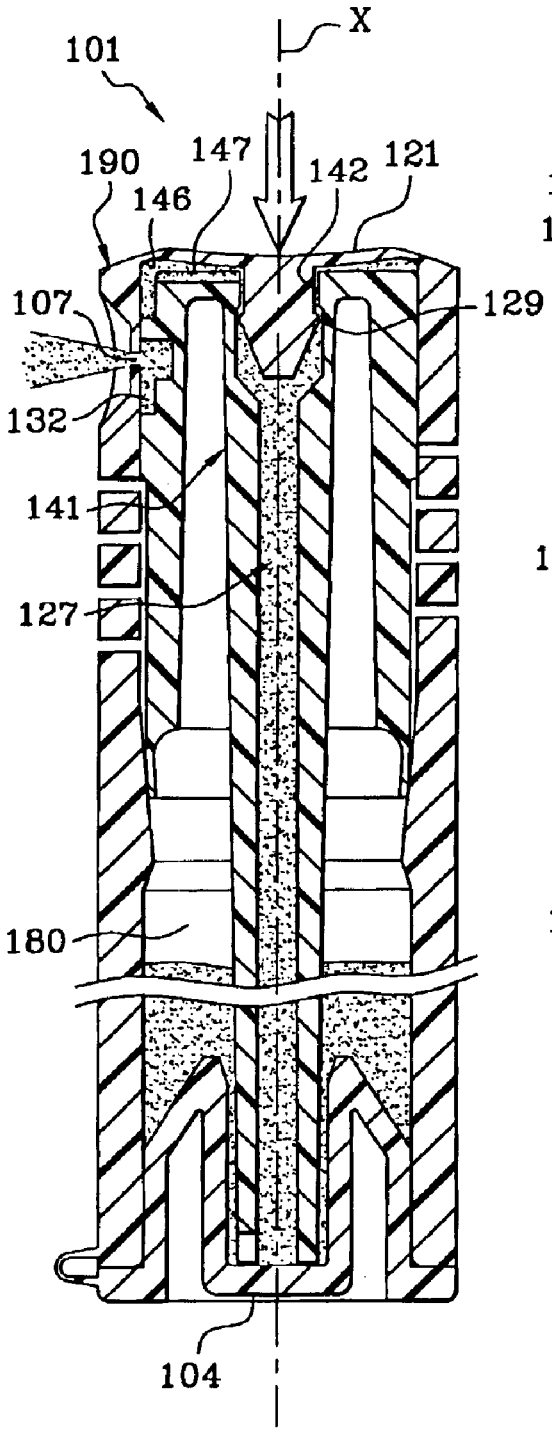
Figure 6D:
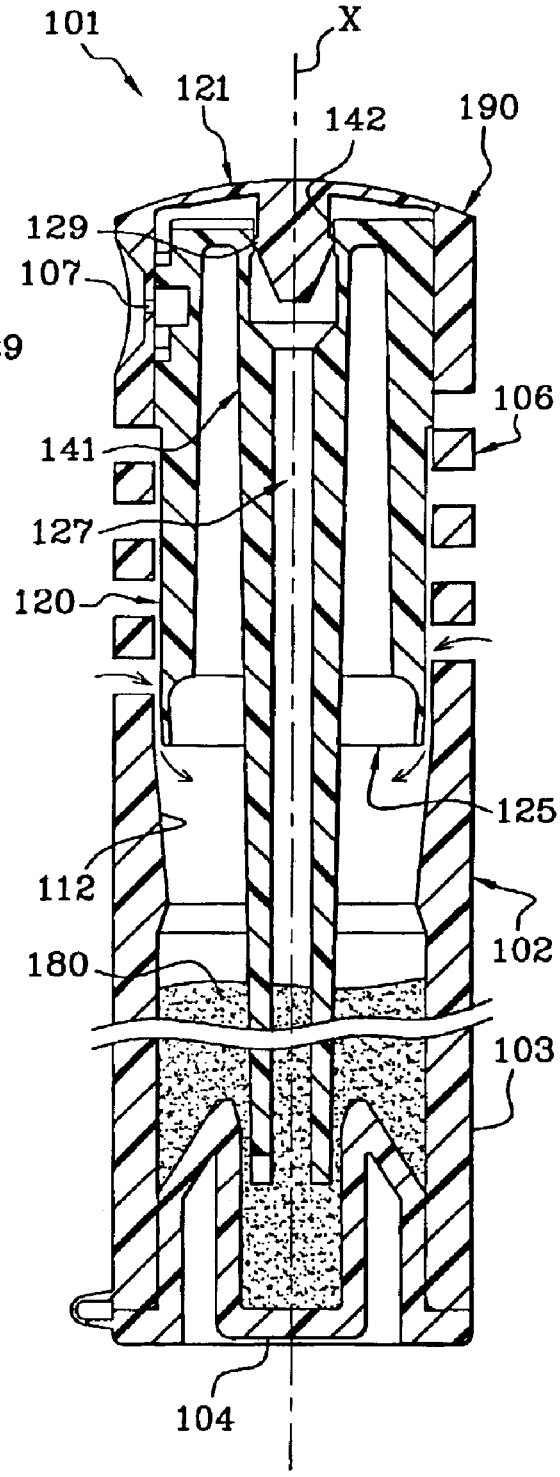
Figure 7:
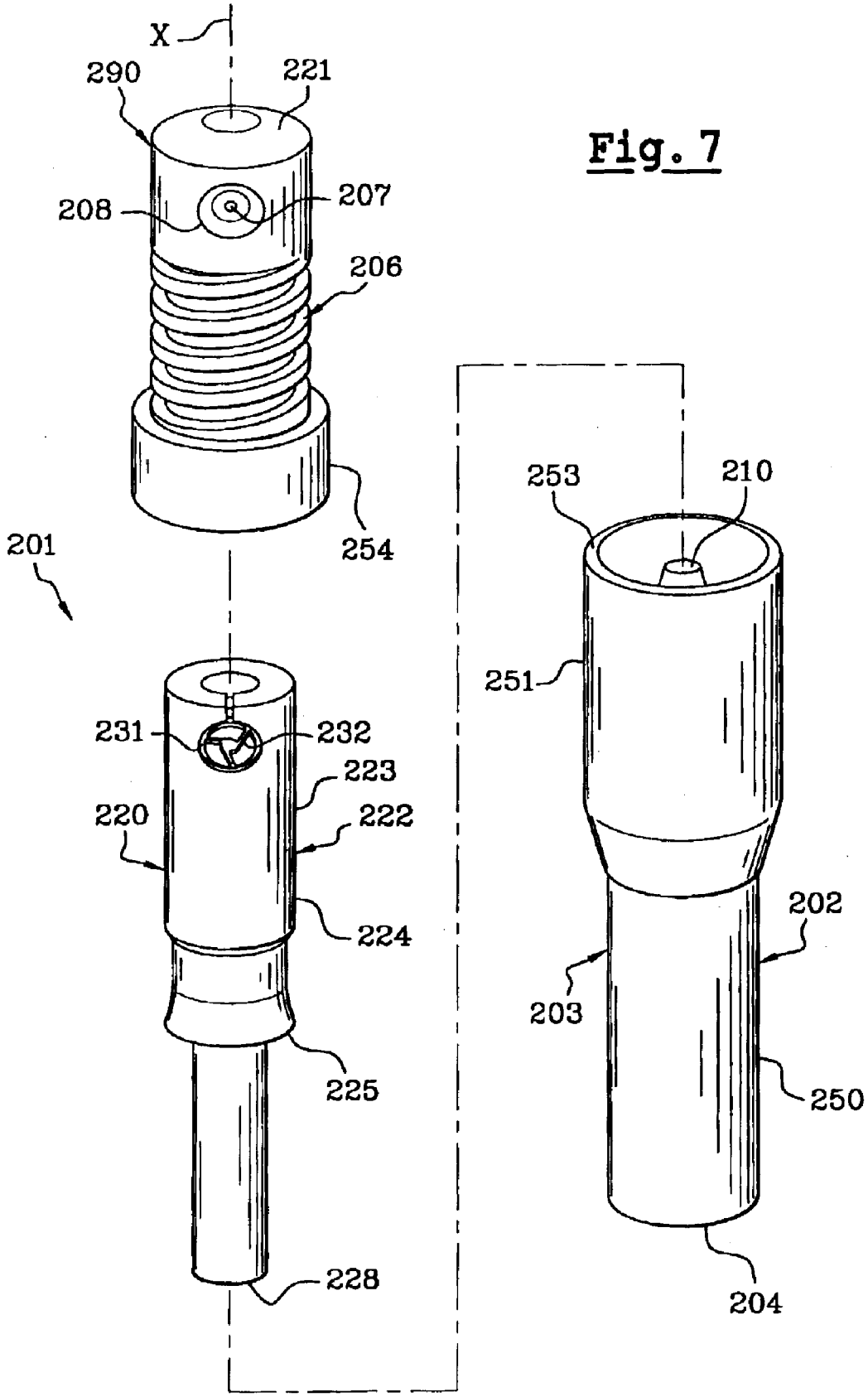
FIGS. 7 and 8A–8D depict a third embodiment of the packaging and dispensing assembly according to the invention.

On the same side as the dispensing orifice 107, the upper surface of the transverse wall 140 has a groove 147 which, as will be seen in more detail below, makes it possible to maintain communication between the feed channel 127 and the dispensing orifice 107 when the convex wall 121 corresponds to a profile as represented in FIG. 6C.

On the side facing the dispensing orifice 107, the external surface of the part 123 of the lateral skirt 122 has a recess 131. When the assembly is fitted together, the recess 131 is centered on the dispensing orifice 107 and, with the internal surface of the body 103, defines a plurality of vortex channels 132 in communication with the spray orifice 107 and with the space formed between the convex wall 121 and the transverse collar 140.

The axial skirt 141 delimits an internal channel which, in the vicinity of its upper end 142, has a first interior cross section. The portion 142 is extended by a portion 143 having a second interior cross section, which is larger than the first. The portion 143 is extended by a portion 144 with an interior cross section smaller than the first and second cross sections. The portion 144 constitutes a major portion of the total height of the skirt 141, and it extends as far as a free end 128 located in the vicinity of the bottom of the container.

In the resting position represented in FIG. 6A, the crenellated edge 128 of the axial skirt 141 is located at a distance from the bottom 104 at least equal to the desired actuation travel, while being as close as possible to the said bottom in order to be immersed in the product for as long as possible.

The wall 121 connects with a stud 145 whose external surface has an annular bead 129, which, in the resting position of FIG. 6A, is in leaktight engagement with the internal surface of the portion 142.

During use, the consumer exerts an axial pressure on the surface 121 of the actuation component 190 (FIG. 6B). In response to this axial pressure, the spring 106 compresses and the movable component 120 descends with the annular lip 125 in leaktight engagement with the internal surface 112 of the body 103. When this happens, the volume 180 defined between the bottom 104 and the movable component 120 decreases, and the product which is contained in it is pressurized and rises through the annular passage 127. The insertion movement continues until complete compression of the spring 106 and/or until the crenellated edge 128 of the axial skirt 141 abuts against the bottom 104 of the container 102. In this position, the volume 180 is a minimum, and the lateral part of the actuation component 190 is lowered, for example, to an axis. The movable component 120 is axially immobilized inside the container 102.

When pressure continues to be exerted on the wall 121, the profile of the latter inverts as represented in FIG. 6C, and the annular bead 129 ceases to be in leaktight engagement against the part 142 of the axial skirt 141. The product contained in the feed channel 127 then rises in the direction of the transverse wall 121, passes through the groove 147 of the annular collar 140, flows through the vortex channels 132, and is sprayed via the dispensing orifice 107.

When the consumer relaxes the pressure being exerted on the surface 121 of the actuation component 190 (FIG. 6D), the wall 121 regains its convex profile in FIGS. 6A and 6B. The annular bead 129 returns into leaktight engagement against the portion 142 of the axial skirt 141, and the communication between the delivery orifice 107 and the feed channel 127 is broken. In addition, the movable component 120, as well as the actuation component 190 to which it is coupled, rises axially under the effect of the spring 106.

The progressively decreasing thickness of the wall of the body 103 of the container 102, coupled with the inertia or flexibility of the material forming the annular lip 125 of the movable component, with the abrupt thrust generated by the spring 106, and with the slightly reduced pressure which can be created inside the container when the rising movement of the movable component 120 is initiated, is favorable for maintaining a slight separation between the free edge of the annular lip 125 of the movable component 120 and the internal surface 112 of the body 103, and for doing so during at least a part of the rising movement of the movable component 120. Air can thereby flow inside the container 102, so as to re-establish a pressure equilibrium.

When the movable component 120 reaches its upper position (FIG. 6A), the free edge of the annular lip 125 is again in leaktight engagement with the internal surface 112 of the body of the container. The volume 180 is again a maximum. The assembly is ready for subsequent actuation.

During the next actuation, everything takes place in the same way, except the volume pressurized by the movable component 120 is reduced by the volume of product which was dispensed during the previous actuation, this volume having been replaced by a corresponding volume of air.

In the embodiment of FIGS. 7 and 8A–8D, the body 203 of the container 202 includes a cylindrical first portion 250 adjacent to the bottom 204, and a second cylindrical portion 251, which has a larger internal cross section than the portion 250 and is separated from the latter by a shoulder 252. The second cylindrical portion 251 terminates in a free edge 253 delimiting an opening. The container 202 is made of polypropylene.

As can be seen in FIGS. 8A–8D, and in the same way as for the previous embodiment, the wall of the body has a thickness increasing progressively in the direction of the bottom 204 below the shoulder 252, and substantially over one-third of the height of the portion 150 of the body 203. Over this portion of the body 203, the distance to the axis X from the internal surface 212 of the body 203 hence increases progressively in the opposite direction from the bottom 204.

Inside the container 202, an axial element 210 projects from the bottom. In the illustrated embodiment, the axial element 210 extends substantially as far as the free edge 253.

The assembly 201 also includes an actuation component 290 configured in the form of a cylindrical element made of POM, one end of which is closed by an end wall 221. In the vicinity of its periphery, the wall 221 includes an annular zone 246 having a smaller thickness, which as with the previous embodiment, allows deformation to flatten or invert the convex wall 221 when the lateral wall of the actuation component 290 is axially immobilized.

In the vicinity of its end which is closed by the wall 221, the cylindrical element is pierced by a dispensing orifice 207 which opens at the bottom of a recess 208.

Inside the actuation component 290, an axial skirt 245 projects from the transverse wall 221, and terminates in a portion 229 which flares outwards slightly.

On the opposite side from the wall 221, the cylindrical element is extended by a coiled portion forming a spring 206. On the opposite side of the spring 206 from the actuation component, the spring is connected to an annular portion 254 whose external cross section is slightly less than the internal cross section of the portion 251 of the container 202, so as to be force-fitted into it, the lower edge of the annular portion 254 is in abutment against the shoulder 252 (FIG. 8A).

The assembly according to this embodiment also include a movable component 220 having a tubular element 222, which has a first portion 223 extending over a height slightly less than the axial height of the axial skirt 245 of the actuation component 290, then extended by a portion 224 with an internal cross section slightly larger than the internal cross section of the portion 223, and slightly larger than the external cross section of the axial element 210.

Over the lower half of the tubular element 222, the external cross section of the tubular element 222 is substantially smaller than its cross section over its upper half, so as to define a volume which is large enough to contain the product to be packaged.

Figure 8A:
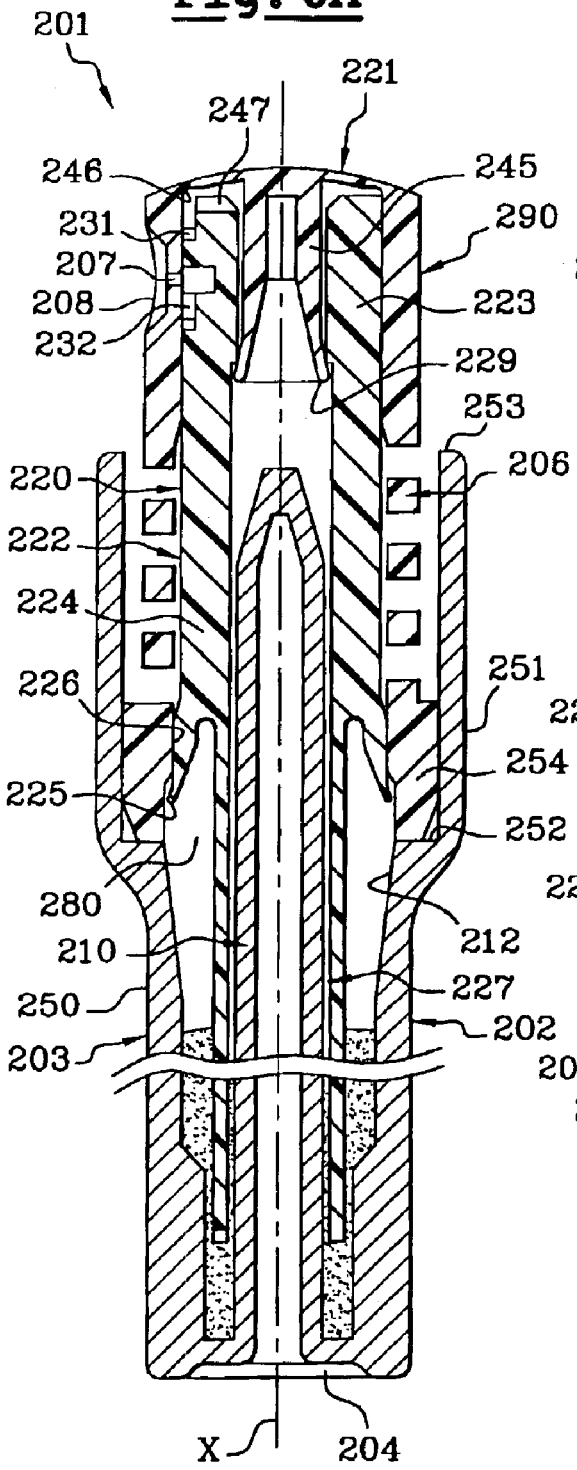

In order to fit the assembly together in the way represented in FIG. 8A, after introduction of the product into the body of the container 202 via the free end 253, the movable component 220, optionally fitted with the actuation component 290, is introduced into the container 202, with the axial element 210 being introduced inside the skirt 222 of the movable component 220 while leaving an annular channel 227 all around the axial element 210. The introduction movement is continued until the part 254 arranged below the spring 206 is in abutment against the shoulder 252.

The coupling between the actuation component 290 and the movable component 220 may take place by force-fitting, snap-fastening, adhesive bonding or by welding.

When fitted together as in FIG. 8A, a crenellated edge 228 of the axial skirt 222 is located at a distance from the bottom 204 at least equal to the desired actuation travel, while preferably being as close as possible to the bottom in order to be immersed in the product for as long as possible.

In the resting position represented in FIG. 8A, an annular zone of the flared portion 229 of the axial skirt 245 bears in a leaktight fashion against a lower edge of the portion 223 with the smaller internal cross section. Above the sealing zone, an annular channel exists between the exterior surface of the axial skirt 245 and the internal surface of the portion 223 of the movable component 220. This annular channel opens into a space formed between the internal surface of the wall 221 and the upper edge of the movable component 220.

Figure 8B:
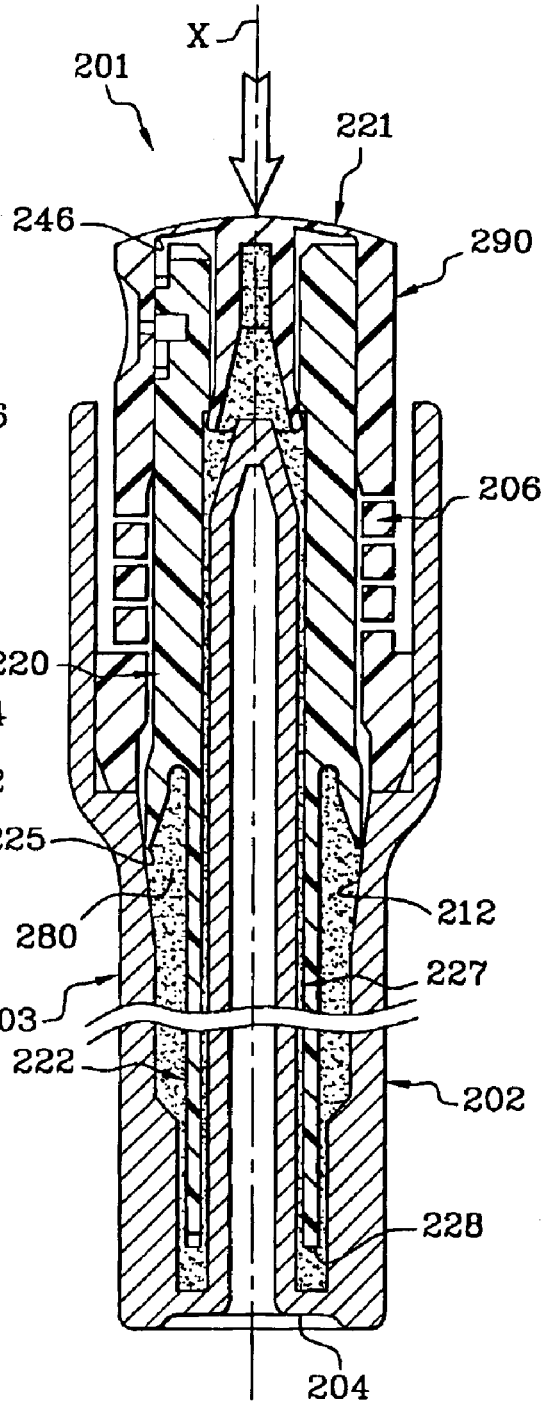
Figure 8C:
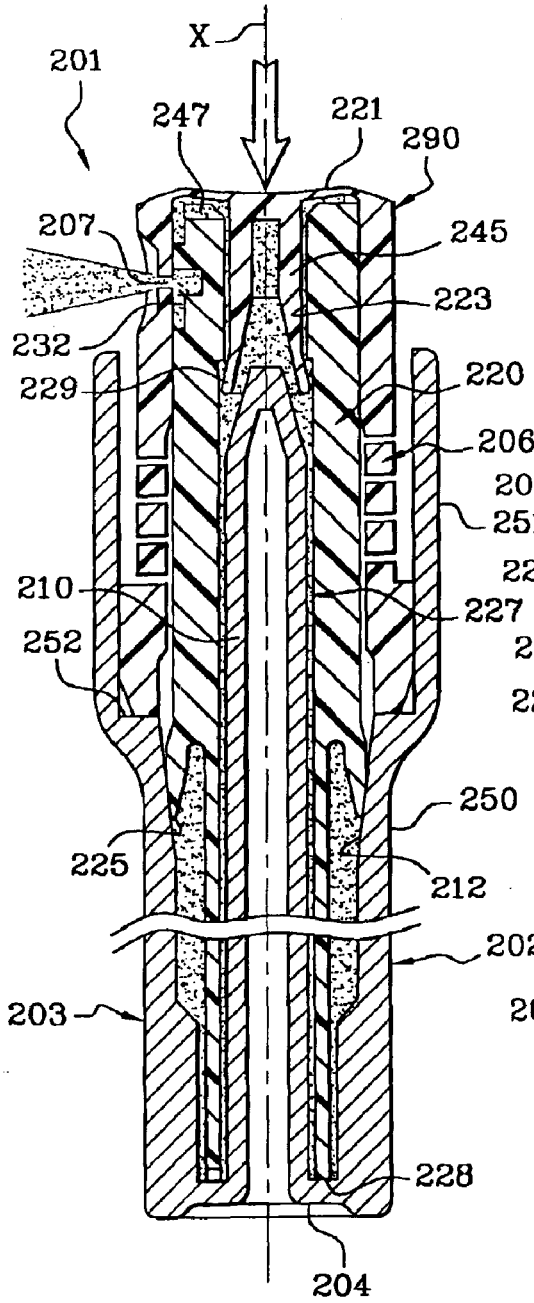
Figure 8D:
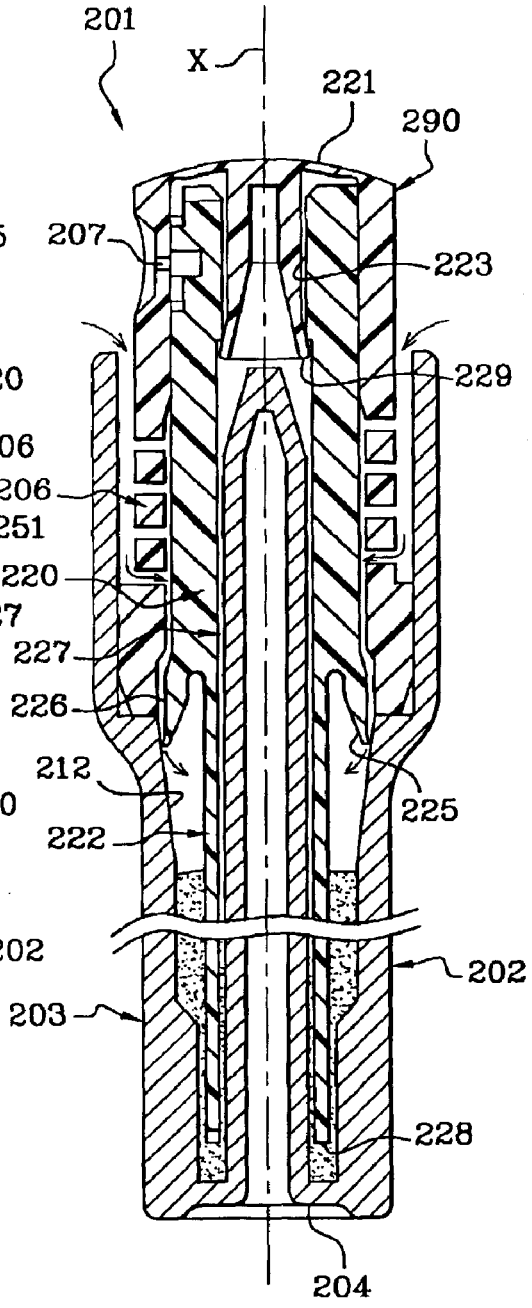
Figure 9:
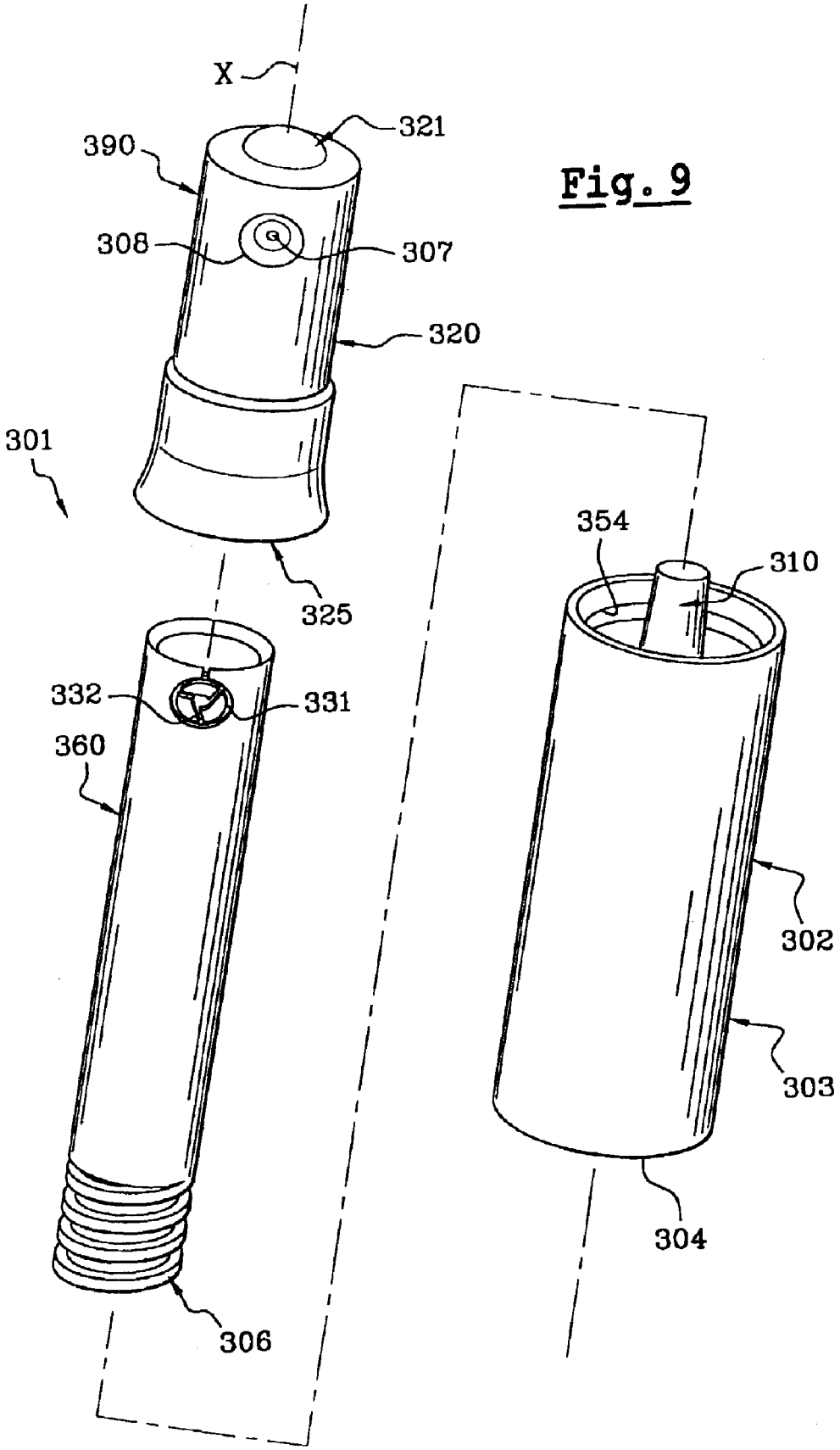
FIGS. 9 and 10A–10D depict a fourth embodiment of the packaging and dispensing assembly according to the invention.

On the same side as the dispensing orifice 207, the upper edge of the movable component 220 has a groove 247, which, as will be seen in more detail below, makes it possible to maintain communication between the feed channel 227 and the dispensing orifice 207 when the convex wall 221 corresponds to a profile as represented in FIG. 8C.

On the side facing the dispensing orifice 207, the external surface of the part 223 of the movable component 220 has a recess 231. When the assembly is fitted together, the recess 231 is centered on the dispensing orifice 207 and, with the internal surface of the actuation component 290, defines a plurality of vortex channels 232 in communication with the spray orifice 207 and with the space formed between the convex wall 221 and the upper edge of the movable component 220.

Substantially half-way up its height, the movable component 220 includes an annular lip 225, which is turned downwards while flaring outwards slightly. In the resting position represented in FIG. 8A, a portion 226 of the movable component 220, located just above the lip 225, is applied in a leaktight fashion against the internal surface of the portion 254 formed under the spring 206. During the descending movement of the movable component 220, at least when the portion 226 ceases to be in leaktight engagement with the portion 254 located below the spring 206, the lip 225 is in leaktight engagement against the surface 212 of the body 203.

In the resting position represented in FIG. 8A, the volume 280 delimited between the movable component 220 and the bottom 204 of the container is a maximum.

During use, the consumer exerts an axial pressure on the surface 221 of the actuation component 290 (FIG. 8B). In response to this axial pressure, the spring 206 compresses and the movable component 220 descends with the annular lip 225 in leaktight engagement with the internal surface 212 of the body 203. When this happens, the volume 280 defined between the bottom 204 and the movable component 220 decreases, and the product which is contained in it is pressurized and rises through the annular passage 227.

The insertion movement continues until complete compression of the spring 206 and/or until the crenellated edge 228 of the axial skirt 222 of the movable component abuts against the bottom 204 of the container 202 (FIG. 8C). In this position, the volume 280 is a minimum, and the lateral part of the actuation component 290 is in axial abutment. The movable component 220 is axially immobilized inside the container 202. When pressure continues to be exerted on the wall 221, the profile deforms or inverts and the annular zone of the flared part 229 of the axial skirt 245 ceases to be in leaktight engagement against the lower edge of the portion 223 of the movable component 220.

The product contained in the feed channel 227 then rises in the direction of the transverse wall 221, passes through the groove 247, flows through the vortex channels 232, and is sprayed via the dispensing orifice 207.

When the consumer relaxes the pressure being exerted on the surface 221 of the actuation component 290 (FIG. 8D), the wall 221 regains its convex profile in FIGS. 8A and 8B. The annular zone of the flared part 229 of the axial skirt 245 returns into leaktight engagement against the lower edge of the portion 223 of the movable component 220. The communication between the delivery orifice 207 and the feed channel 227 is broken.

The movable component 220, as well as the actuation component 290 to which it is coupled, rises axially under the effect of the spring 206.

The progressively decreasing thickness of the wall of the body 203 of the container 202, coupled with the inertia or pliability of the material forming the annular lip 225 of the movable component, with the abrupt thrust generated by the spring 206, and with the slightly reduced pressure which can be created inside the container when the rising movement of the movable component 220 is initiated, is favorable for maintaining a slight separation between the free edge of the annular lip 225 of the movable component 220 and the internal surface 212 of the body 203, and for doing so during at least a part of the rising movement of the movable component 220. Air can then flow inside the container 202, so as to re-establish a pressure equilibrium.

When the movable component 220 reaches its upper position (FIG. 8A), the portion 226 of the movable component 220, located just above the lip 225, is again applied in a leaktight fashion against the internal surface of the portion 254 formed under the spring 206. The volume 280 is again a maximum. The assembly is ready for a subsequent actuation.

During the next actuation, everything takes place in the same way, except the volume pressurized by the movable component 220 is reduced by the volume of product which was dispensed during the previous actuation, this volume having been replaced by a corresponding volume of air.

The embodiment in FIGS. 9 and 10A–10D constitutes a variant of the previous embodiment. For the sake of clarity in the description, only the elements which differ from the previous embodiment will be described in detail. The elements which are identical to those of the previous embodiment have a numerical reference identical to that which was assigned to them in the previous embodiment, with 100 added.

According to this embodiment, the component 320 which is movable relative to the body 303 of the container is obtained by molding in polyethylene with the actuation component 390. Hence, the lip 325, which bears in a leaktight fashion against the incline surface 312 when the movable component passes from the first to the second position, is formed by the open end of the actuation component, on the opposite side from the actuation surface 321.

The actuation component 390 is coupled, e.g., force-fitted or snap-fastened, onto an intermediate piece 360 made, e.g., preferably of POM, the lower end of which terminates in a portion forming a spring 306 bearing against the bottom of the container.

The body 303 of the container 302 is made, e.g., preferably of polypropylene.

On an external surface of the intermediate piece 360, the recess 331 and the vortex channels 332 are defined.

The device is closed upstream of the delivery orifice by the interaction of an annular bead 329, which is formed by a portion 345 secured to the actuation component 390 and which, when the assembly is in the rest position, bears in a leaktight fashion against a small cross-section tubular portion 323 of the intermediate piece 360. In response to an actuation action or force on the surface 321, the annular bead 329 descends in front of a larger cross-section portion 324 of the intermediate piece 360, so as to allow the product to pass around the bead 329.

Figure 10A:
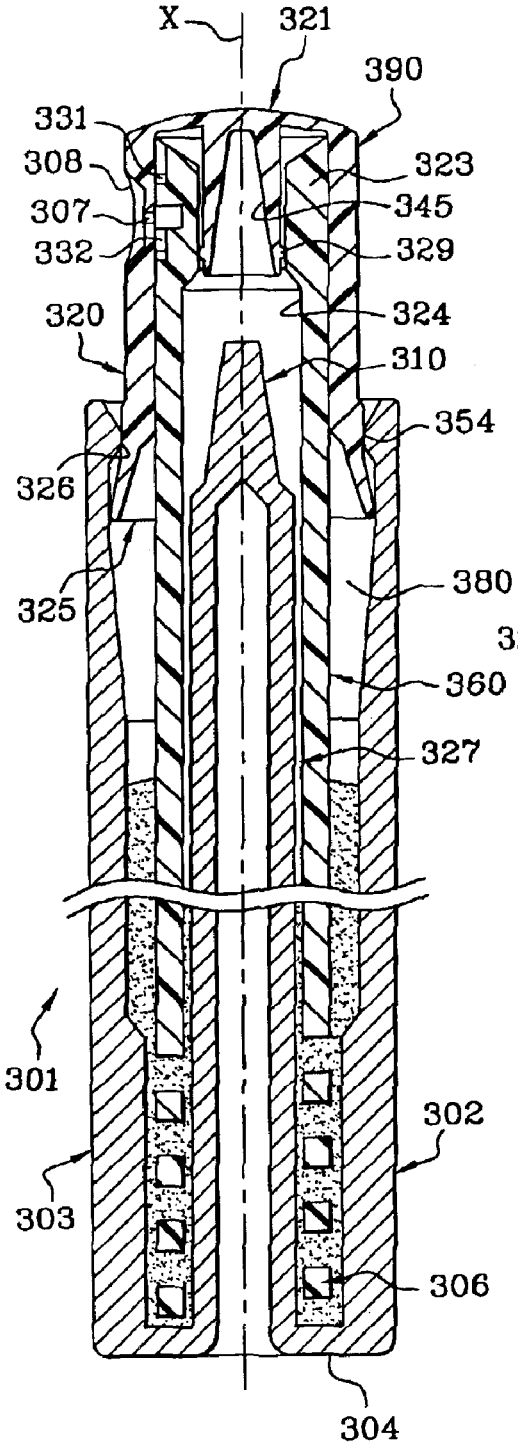

In the rest position, illustrated in FIG. 10A, an annular portion 326 located above the lip 325 is applied in a leaktight fashion against an annular bead 354 formed by the internal surface of the body 303 in the vicinity of its open end.

Figure 10B:
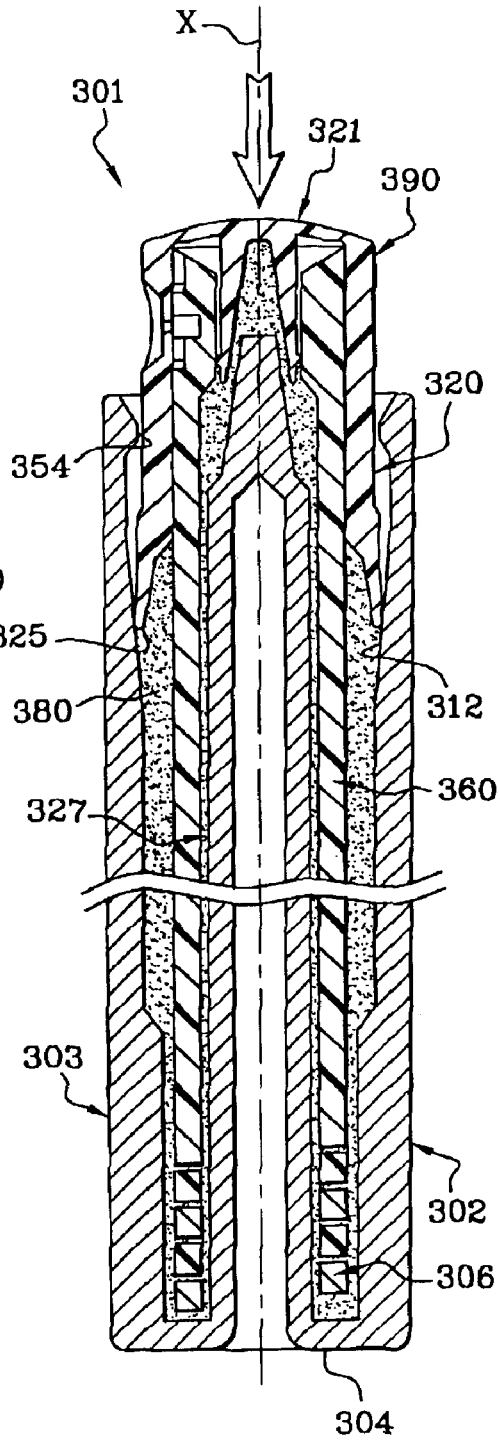

During use, the consumer exerts an axial pressure on the surface 321 of the actuation component 390 (FIG. 10B). In response to this axial pressure, the spring 306 compresses and the actuation component 390 descends with the annular lip 325 in leaktight engagement with the internal surface 312 of the body 303. When this happens, the volume 380 defined between the bottom 304 and the movable component 320 decreases, and the product is pressurized and rises through the annular passage 327.

The insertion movement can continue until complete compression of the spring 306 against the bottom 304 of the container 302, but without the turns of the component being able to be completely contiguous, so as to maintain communication between the channel 327 and the portion of the container exterior to the intermediate piece 360. In this position, the volume 380 is a minimum. The lateral part of the actuation component 390, as well as the intermediate piece 360, are axially immobilized inside the container 302.

Figure 10C:
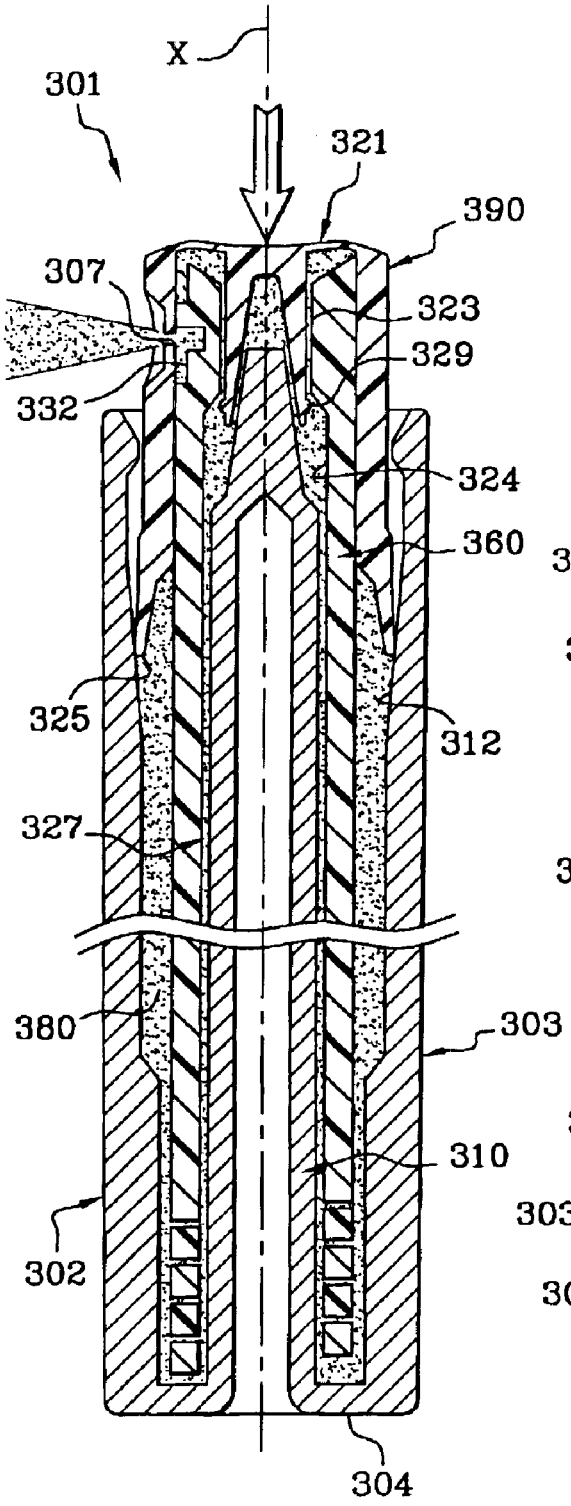
Figure 10D:
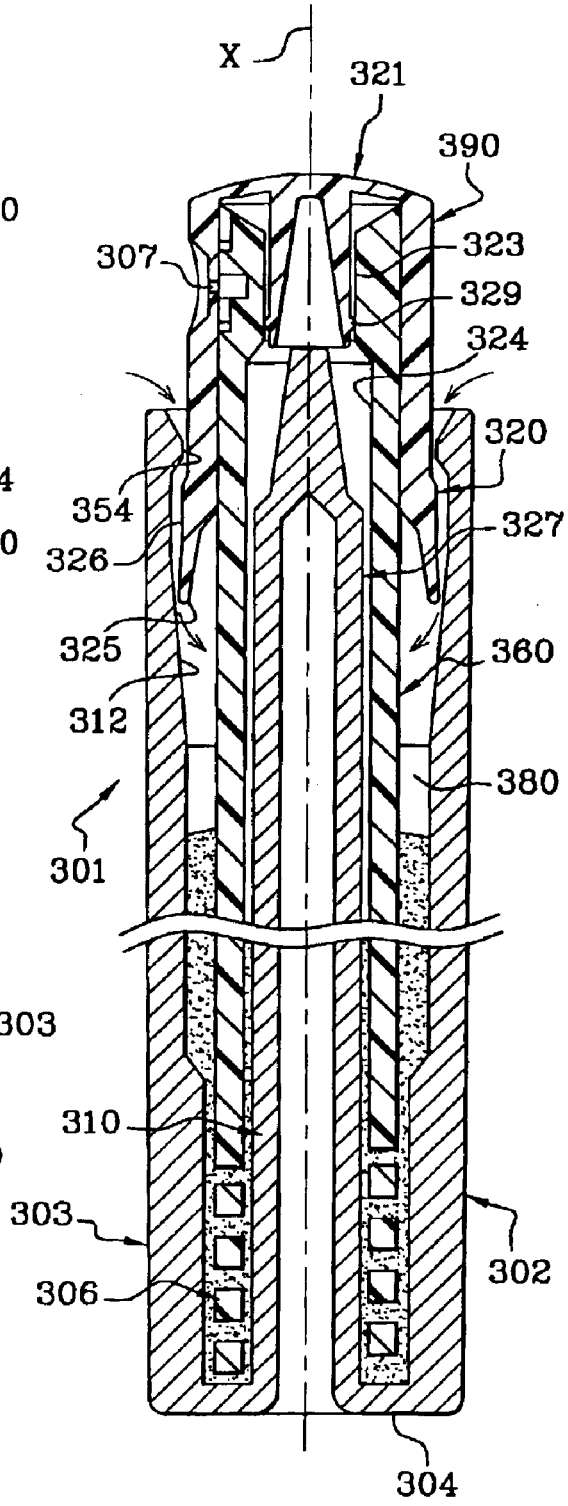
Figure 11:
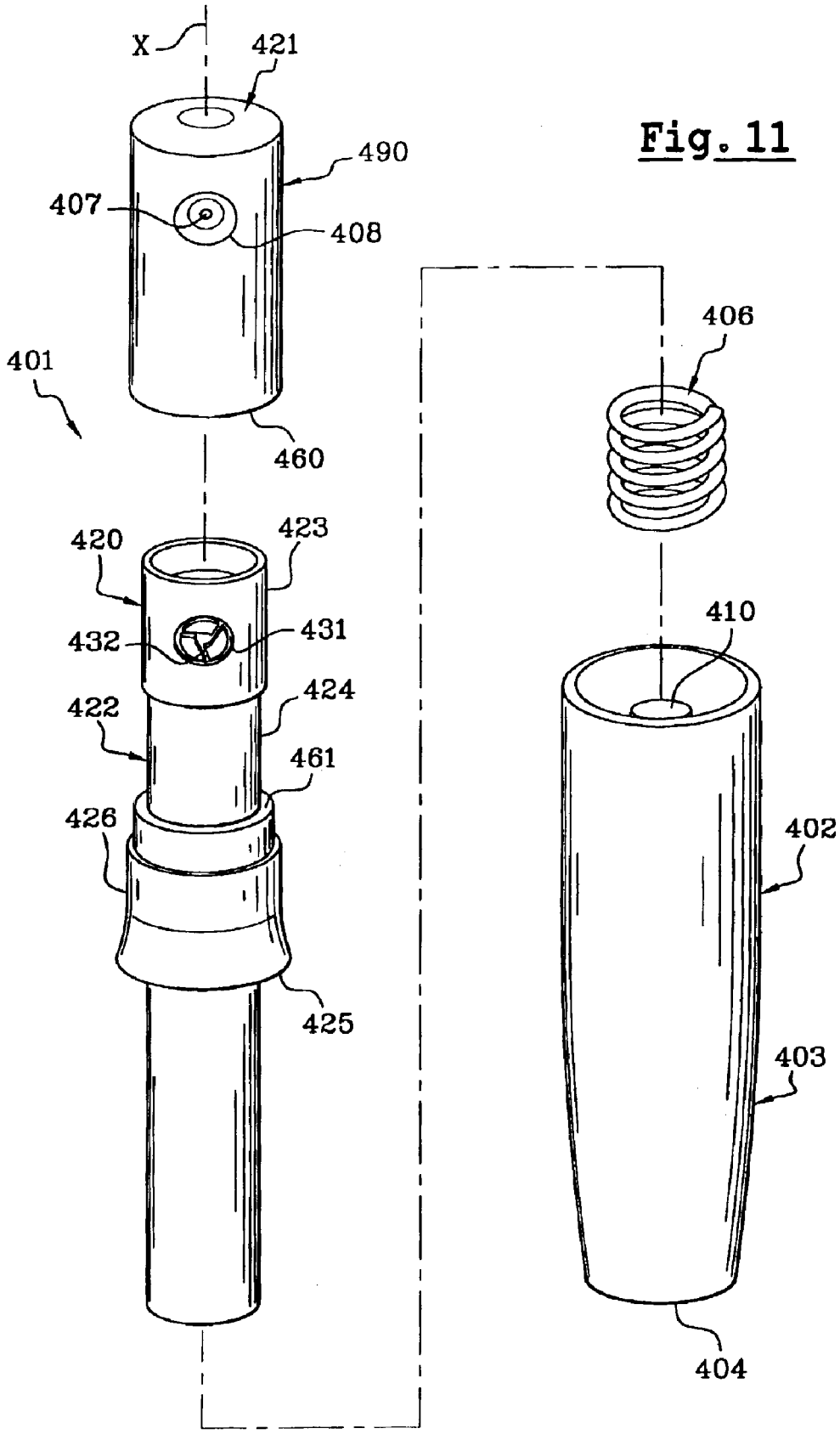
FIGS. 11 and 12A–12D depict a fifth embodiment of the packaging and dispensing assembly according to the invention.

When continuing to exert a pressure on the wall 321, the profile of the latter deforms or inverts in the way represented in FIG. 10C, and the annular bead 329 ceases to be in leaktight engagement against the small cross-section portion 323 of the intermediate piece 360. The product contained in the feed channel 327 then rises in the direction of the transverse wall 321, flows through the vortex channels 332, and is sprayed via the dispensing orifice 307.

When the consumer relaxes the pressure being exerted on the surface 321 of the actuation component 390 (FIG. 10D), the wall 321 regains its convex profile in FIGS. 10A and 10B. The annular bead 329 returns into leaktight engagement against the smaller cross-section portion 323 of the intermediate piece 360. The communication between the delivery orifice 307 and the feed channel 327 is broken.

The movable component 320, as well as the actuation component 390 with which it forms a single integral piece, rises axially under the effect of the spring 306.

The progressively decreasing thickness of the wall of the body 303 of the container 302, coupled with the inertia or pliability of the material forming the annular lip 325 of the movable component, with the abrupt thrust generated by the spring 306, and with the slightly reduced pressure which can be created inside the container when the rising movement of the movable component 320 is initiated, is favorable for maintaining a slight separation between the free edge of the annular lip 325 of the movable component 320 and the internal surface 312 of the body 303 during at least a part of the rising movement of the movable component 320. Air can then flow inside the container 302, so as to re-establish a pressure equilibrium.

When the movable component 320 reaches its upper position (FIG. 10A), the portion 326 located just above the lip 325 is again applied in a leaktight fashion against the bead 354 formed on the interior surface of the body 303. The volume 380 is again a maximum. The assembly 301 is ready for a subsequent actuation. During the next actuation, everything takes place in the same way, except the volume pressurized by the movable component 320 is reduced by the volume of product which was dispensed during the previous actuation, this volume having been replaced by a corresponding volume of air.

The embodiment in FIGS. 11 and 12A–12D constitutes another variant of the embodiment in FIGS. 7 and 8A–8D. For the sake of clarity in the description, only the elements which differ from the embodiment in FIGS. 7 and 8A–8D will be described in detail. The elements which are identical to those of the embodiment in FIGS. 7 and 8A–8D have a numerical reference identical to that which was assigned to them in this embodiment, with 200 added.

According to this embodiment, the spring 406 made of metal or plastic consists of an attached element arranged between the axial skirt 445 of the actuation component 490 and the axial portion 410 of the body 403 of the container 402.

The movable component 420 is preferably made of, e.g., polyethylene. The body 403 of the container 402, as well as the actuation component 490, are preferably made of, e.g., polypropylene.

Also according to this embodiment, the actuation component 490 is axially movable, relative to the movable component 420, over a travel which is necessary and sufficient in order to obtain alignment of the spray orifice 407 and the recess 431, in which the vortex channels 432 are formed.

After the spray orifice and the recess 431 have been brought into alignment, a free edge 460 of the actuation component 490 abuts against a shoulder 461 of the movable component 420, so as to push the latter in the direction of the bottom 404.

Figure 12A:
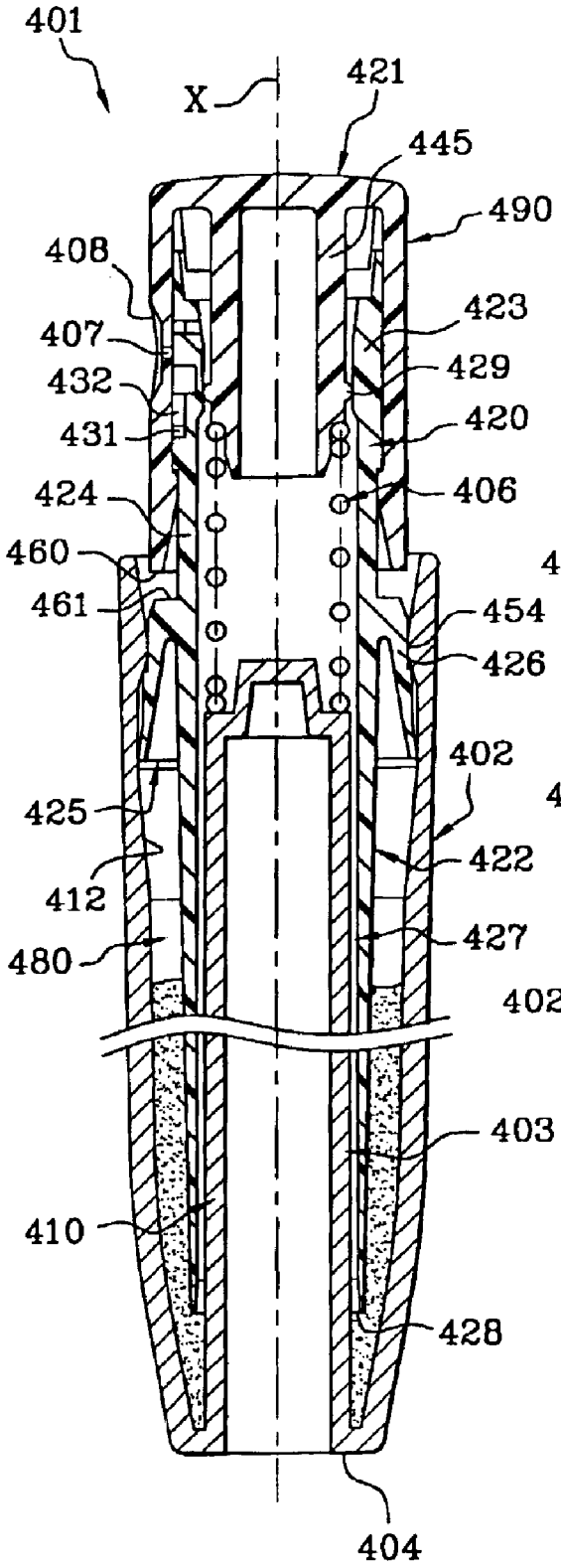

In the resting position illustrated in FIG. 12A, an annular portion 426 located above the lip 425 is applied in a leaktight fashion against an annular bead 454 formed by the internal surface of the body 403 in the vicinity of its open end.

In the same way as for the previous embodiment, the device is closed upstream of the delivery orifice 407 by the interaction of an annular bead 429, which is formed by a portion 445 secured to the actuation component 490, and a small internal cross-section tubular portion 423 of the movable component 420, against which the bead 429 bears in a leaktight fashion when the assembly is in the rest position (FIG. 12A). In response to an actuation action or force on the surface 421 (FIG. 12C), the annular bead 429 descends in front of a larger cross-section portion 424 of the movable component 420, so as to allow the product to pass around the bead 429.

Figure 12B:
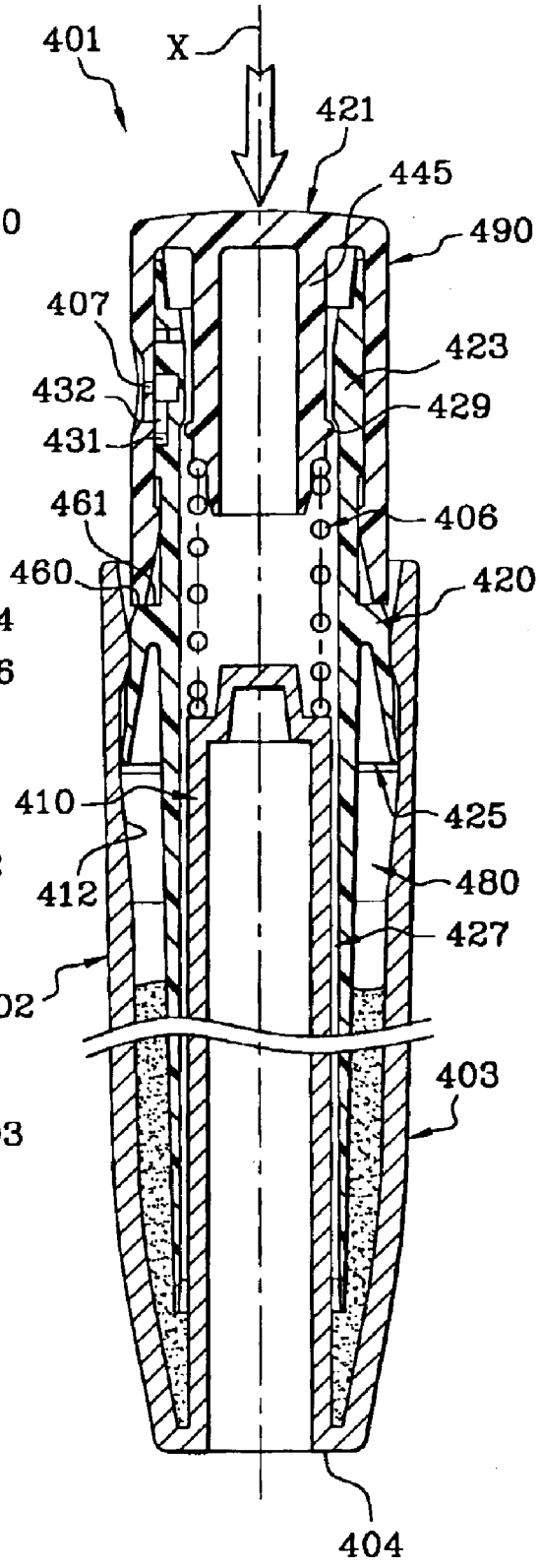
Figure 12C:
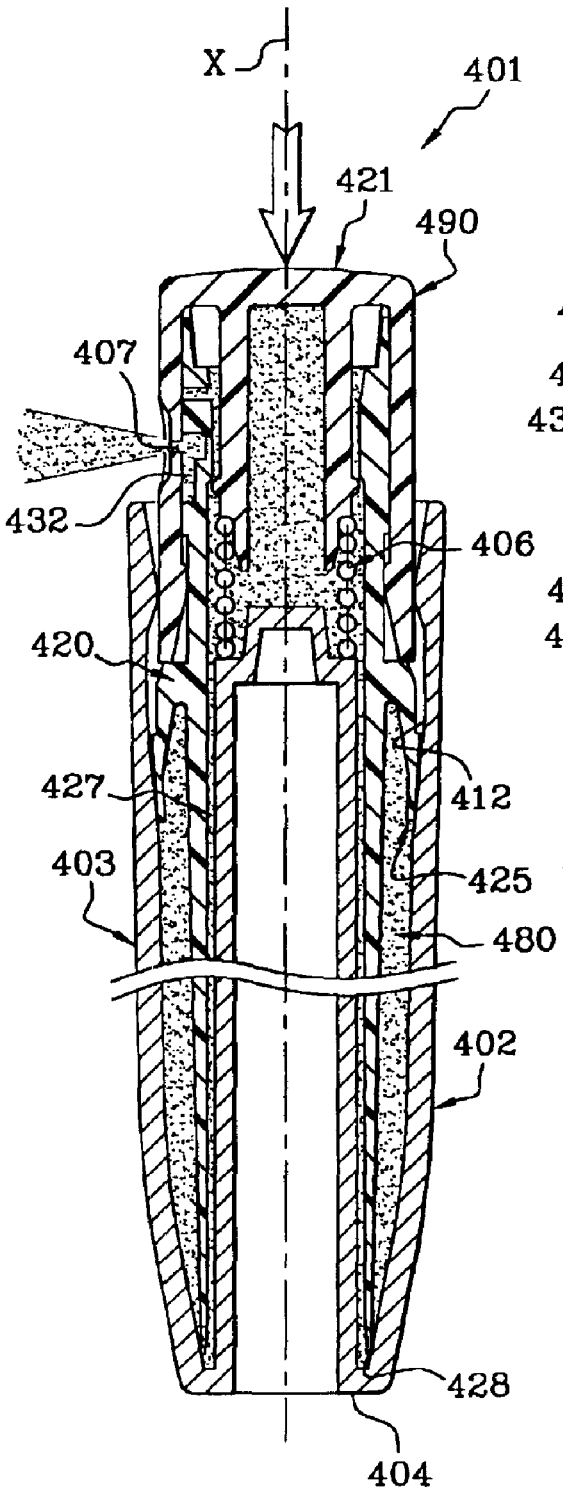
Figure 12D:
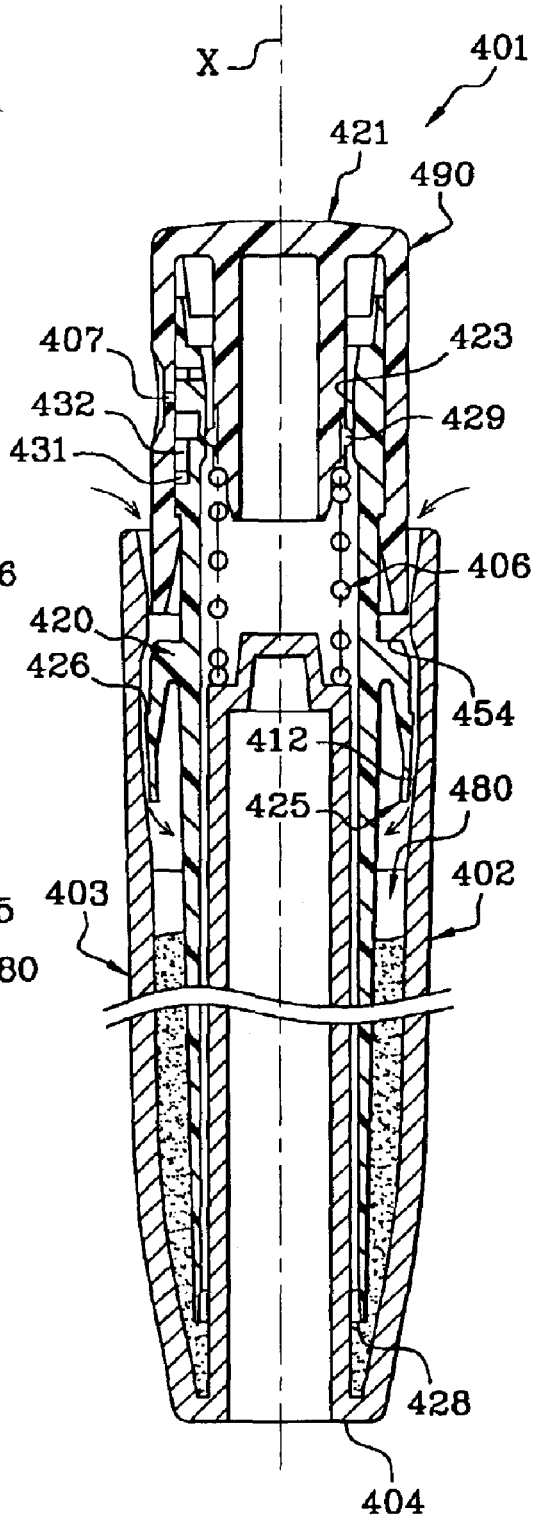

During use, the consumer exerts an axial pressure on the surface 421 of the actuation component 490 (FIG. 12B). In response to this axial pressure, the spring 406 compresses and the actuation component 490 descends over a short travel, during which the spray orifice 407 comes into alignment with the center of the recess 431 in which the vortex channels 432 are formed. When this happens, the annular bead 429 also ceases to be in leaktight engagement against the small internal cross-section portion 423 of the movable piece 420. The movement of the actuation component on its own continues until the lower edge 460 of the actuation component is in abutment against the shoulder 461 of the movable component 420.

After this stage (FIG. 12C), the movable component 420 descends in the direction of the bottom 404, with the annular lip 425 in leaktight engagement with the internal surface 412 of the body 403.

The volume 480 defined between the bottom 404 and the movable component 420 decreases, and the product which is contained in it is pressurized and rises through the annular passage 427. The product contained in the feed channel 427 then rises in the direction of the transverse wall 421, flows through the vortex channels 432, and is sprayed via the dispensing orifice 407.

The insertion movement continues until complete compression of the spring 406, or until a crenellated edge 428 of the movable component 420 abuts against the bottom 404 of the container 402.

When the consumer relaxes the pressure being exerted on the surface 421 of the actuation component 490 (FIG. 12D), the action component 490 rises by a small height independently of the movable component 420. When this happens, the spray orifice 407 is no longer centered on the recess 431 in which the vortex channels 432 are formed, and the annular bead 429 returns into leaktight engagement against the smaller internal cross-section portion 423 of the movable component 420. The spraying is stopped.

Next, by means of a suitable stop system, the actuation component 490 pushes the movable component 420 in the opposite direction from the bottom. The progressively decreasing thickness of the wall of the body 403 of the container 402, coupled with the inertia or pliability of the material forming the annular lip 425 of the movable component, with the abrupt thrust generated by the spring 406, and with the slightly reduced pressure which can be created inside the container when the rising movement of the movable component 420 is initiated, is favorable for maintaining a slight separation between the free edge of the annular lip 425 of the movable component 420 and the internal surface 412 of the body 403 during at least a part of the rising movement of the movable component 420. Air can then flow inside the container 402, so as to re-establish a pressure equilibrium.

When the movable component 420 reaches its upper position (FIG. 12A), the portion 426 of the movable component 420, located just above the lip 425, is again applied in a leaktight fashion against the bead 454 formed by the internal surface of the body 403 of the container 402. The volume 480 is again a maximum. The assembly 401 is ready for a subsequent actuation.

During the next actuation, everything takes place in the same way, except the volume pressurized by the movable component 420 is reduced by the volume of product which was dispensed during the previous actuation, this volume having been replaced by a corresponding volume of air.

In all the embodiments described above, although this is not shown explicitly in the drawing, preferably some liquid remains held inside the feed channel 27, 127, 227, 327, 427, e.g., by capillary action, when the movable component 25, 125, 225, 325, 425 returns to the upper position, so that, during the subsequent actuation, the spraying of the product is substantially concomitant with the insertion of the actuation surface 21, 121, 221, 321, 421.

Obviously, numerous modifications and variations of the present invention are possible in light of the above teachings. It is therefore to be understood that, within the scope of the appended claims, the invention may be practiced otherwise than as specifically described herein.

What is claimed is:

1. An assembly for containing and dispensing a product comprising:

(a) a container for containing a product, the container including a container body having a closed end, the container further including an internal surface;

(b) an actuation component;

(c) at least one dispensing orifice through which the product can be dispensed from the assembly;

(d) a movable component at least partially disposed in the body of the container, wherein the movable component is movable relative to the body, in response to a force exerted manually on the actuation component, from a first position in which a volume between the movable component and the closed end of the container is a first amount to a second position in which said volume is a second amount smaller than said first amount so as to pressurize the product in said volume to deliver the product through the at least one dispensing orifice, and wherein the movable component is movable to return from the second position toward the first position; and (e) at least one passage formed between the movable component and the internal surface of the container during at least a portion the return of said movable component from the second position toward the first position such that air passes through said at least one passage into the container.

2. An assembly according to claim 1, wherein the movable component comprises a lip which is positioned in a leaktight contact against the internal surface of the container when the movable component is moving from the first position to the second, the said internal surface being configured so that, over at least a part of the return movement of the movable component from the second position to the first, said lip is not in leaktight contact with the said internal surface.

3. An assembly according to claim 2, wherein over at least a part of the movement between the said first and second positions, the lip is subjected to an elastic force which increases in a direction toward the second position.

4. An assembly according to claim 3, wherein the internal surface has a circular cross section, the lip is annular, and wherein the distance between a longitudinal axis X of the assembly and said internal surface increases along the axis X in a direction of the return movement from the second position towards the first position.

5. An assembly according to claim 1, further including elastic restoring means for urging the movable component in a direction to return the movable component from the second position towards the first position.

6. An assembly according to claim 5, wherein the elastic restoring means is molded with at least one of the body of the container and the actuation component.

7. An assembly according to claim 6, wherein the movable component is molded with the actuation component.

8. An assembly according to claim 5, wherein the elastic restoring means is molded with an intermediate piece, and wherein the actuation component is mounted on the intermediate piece.

9. An assembly according to claim 8, wherein one end of the elastic restoring means abuts against a bottom of the container.

10. An assembly according to claim 5, wherein the elastic restoring means is made of polyoxymethylene.

11. An assembly according to claim 6, wherein the elastic restoring means and the at least one of the body of the container and the actuation component are made of polyoxymethylene.

12. An assembly according to claim 8, wherein the elastic restoring means and the intermediate piece are made of polyoxymethylene.

13. An assembly according to claim 1, wherein the movable component and the body of the container are made of at least one polyolefin.

14. An assembly according to claim 1, wherein the movable component and the body of the container are formed of at least one of polyethylene and polypropylene.

15. An assembly according to claim 5, wherein the elastic restoring means includes a spring.

16. An assembly according to claim 15, wherein the spring is formed of metal.

17. An assembly according to claim 15, wherein the spring is formed of plastic.

18. An assembly according to claim 1, further including at least one product feed passage in communication with the product inside the container, the assembly further including an opening/closing system, and wherein the at least one dispensing orifice is in selective communication, by way of the opening/closure system, with the at least one product feed passage in communication with the product inside the container.

19. An assembly according to claim 18, wherein the product feed passage is delimited between an element coupled to the body of the container and an element coupled to the movable component.

20. An assembly according to claim 19, wherein the element coupled to the body of the container is molded with the body of the container and wherein the element coupled to the movable component is molded with the movable component.

21. An assembly according to claim 18, wherein the product feed passage is delimited essentially by the movable component.

22. An assembly according to claim 18, wherein the product feed passage is delimited between an element coupled to the body of the container and an intermediate piece.

23. An assembly according to claim 22, wherein said element coupled to the body of the container is molded with the body of the container.

24. An assembly according to claim 22, wherein the actuation component is mounted on said intermediate piece.

25. An assembly according to claim 24, further including elastic restoring means for urging the movable component in a direction to return the movable component from the second position to the first position.

26. An assembly according to claim 25, wherein the elastic restoring means is molded with the intermediate piece.

27. An assembly according to claim 18, wherein the opening/closure system includes an opening/closing element coupled to the body of the container and an opening/closing element coupled to the movable component.

28. An assembly according to claim 27, wherein the opening/closing element coupled to the body of the container is molded with the body of the container and the opening/closing element coupled to the movable component is molded with the movable component.

29. An assembly according to claim 18, wherein the opening/closure system opens and closes the product feed passage at a location between the movable component and a portion coupled to the actuation component.

30. An assembly according to claim 18, wherein the actuation component includes a surface, and wherein said surface of the actuation component is movable over a travel amount which is greater than a travel amount of other portions of the actuation component, and wherein the communication between the product feed passage and the dispensing orifice is established in response to the movement of the said surface of the actuation component when the other portions of the actuation component are axially stationary.

31. An assembly according to claim 30, wherein the opening/closure system is formed by the interaction of a portion coupled to the actuation component and an intermediate piece.

32. An assembly according to claim 31, further including elastic restoring means for urging the movable component in a direction to return the movable component from the second position to the first position.

33. An assembly according to claim 32, wherein the elastic restoring means is molded with the intermediate piece.

34. An assembly according to claim 1, wherein the second position of the movable component is determined by the engagement of a lower end of the movable component with the closed end of the container.

35. An assembly according to claim 34, wherein the lower end of the movable component includes a crenellated edge.

36. An assembly according to claim 1, further including elastic restoring means for urging the movable component in a direction to return the movable component from the second position to the first position, and wherein the elastic restoring means is deformed during movement of said movable component from said first position to said second position and further wherein a location at which deformation of the elastic restoring means halts defines said second position.

37. An assembly according to claim 1, wherein the closed end of said container is at a bottom of said container, and wherein the bottom closes the body of the container by at least a one of snap-fastening, screwing, adhesive bonding and welding.

38. An assembly according to claim 1, wherein the at least one dispensing orifice is fed by a plurality of vortex-effect channels.

39. An assembly according to claim 5, wherein the elastic restoring means includes a stack of at least three rings, and wherein respective adjacent rings of said stack are connected by two diametrically opposite struts, wherein the struts separating a first ring from a second ring adjacent to the first being are offset 90° with respect to the struts separating the second ring from a third ring which is adjacent to the second.

40. An assembly according to claim 1, wherein said actuation component is molded with the movable component.

41. An assembly according to claim 1, wherein the container body includes a center axis, and wherein a distance from said center axis to said internal surface decreases along said axis in a direction toward said closed end.

42. An assembly according to claim 41, wherein said movable component includes a lip which seals against said internal surface during at least a portion of movement of the movable component from the first position to the second position, and wherein the lip is deformed during at least a portion of movement of the movable component from the second position to the first position to provide the at least one passage between the movable component and the internal surface.

43. An assembly according to claim 42, wherein a product feed passage provides communication between the at least one dispensing orifice and the product in said volume, and wherein the assembly includes an opening/closing system which closes said product feed passage during at least a portion of movement of the movable component from the second position to the first position.

44. An assembly according to claim 43, wherein said opening/closing system closes said product feed passage with a seal between a portion coupled to said actuation component and a portion of said movable component.

45. An assembly according to claim 43, further including an intermediate member, and wherein said opening/closing system closes said product feed passage with a seal between a portion coupled to said actuation component and a portion of said intermediate member.

46. An assembly according to claim 43, wherein said opening/closing system closes said product feed passage with a seal between a portion coupled to said movable component and an element extending from said closed end of said container.

47. An assembly according to claim 1, wherein a product feed passage provides communication between the at least one dispensing orifice and the product in said volume, and wherein the assembly includes an opening/closing system which closes said product feed passage during at least a portion of movement of the movable component from the second position to the first position.

48. An assembly according to claim 47, wherein said opening/closing system closes said product feed passage with a seal between a portion coupled to said actuation component and a portion of said movable component.

49. An assembly according to claim 47, further including an intermediate member, and wherein said opening/closing system closes said product feed passage with a seal between a portion coupled to said actuation component and a portion of said intermediate member.

50. An assembly according to claim 47, wherein said opening/closing system closes said product feed passage with a seal between a portion coupled to said movable component and an element extending from said closed end of said container.

51. An assembly according to claim 1, wherein a product feed passage provides communication between the at least one dispensing orifice and the product in said volume, and wherein the assembly includes an opening/closing system which closes said product feed passage during at least a portion of the movement of the movable component from the second position to the first position.

52. An assembly according to claim 51, wherein said opening/closing system opens said product feed passage after said movable component has reached said second position upon continued application of force to said actuation component.

53. An assembly according to claim 1, wherein said movable component includes a lip which seals against said internal surface of said container during at least a portion of movement of the movable component from the first position to the second position, and wherein the lip is deformed during at least a portion of movement of the movable component from the second position to the first position to provide the at least one passage between the movable component and the internal surface.

* * * * *